US010874213B2

(12) United States Patent
Lawson et al.

(10) Patent No.: US 10,874,213 B2
(45) Date of Patent: Dec. 29, 2020

(54) DRAWER SYSTEM

(71) Applicant: TAG Hardware Systems Ltd., Surrey (CA)

(72) Inventors: Stephen Lawson, Surrey (CA); Stephen Campion, White Rock (CA)

(73) Assignee: Tag Hardware Systems Ltd., Surrey (CA)

( * ) Notice: Subject to any disclaimer, the term of this patent is extended or adjusted under 35 U.S.C. 154(b) by 0 days.

(21) Appl. No.: 16/248,657

(22) Filed: Jan. 15, 2019

(65) Prior Publication Data

US 2020/0221870 A1 Jul. 16, 2020

(51) Int. Cl.
*A47B 88/975* (2017.01)
*A47B 88/90* (2017.01)
*A47B 88/969* (2017.01)

(52) U.S. Cl.
CPC ..... *A47B 88/975* (2017.01); *A47B 88/941* (2017.01); *A47B 2088/976* (2017.01)

(58) Field of Classification Search
CPC ..... A47B 88/941; A47B 88/975
USPC ..... 312/330.1, 348.1, 348.2, 348.3
See application file for complete search history.

(56) References Cited

U.S. PATENT DOCUMENTS 4,118,089 A * 10/1978 Johnson ..... A47B 43/04 312/351
4,161,977 A 7/1979 Baslow
4,213,493 A 7/1980 Haworth
4,258,856 A 3/1981 Marling
4,316,644 A * 2/1982 Johnson ..... A47B 47/06 248/99
4,319,794 A 3/1982 Bachor
4,527,694 A * 7/1985 Bolt ..... H05F 3/02 211/162
4,705,168 A 11/1987 Ward
4,723,816 A 2/1988 Selbert et al.
5,033,529 A 7/1991 Koschade
5,651,596 A 7/1997 Carlson et al.
5,867,873 A 2/1999 Arend
5,951,133 A 9/1999 Dittberner et al.
5,971,516 A 10/1999 Huber
6,443,545 B1 9/2002 Woerner
6,491,173 B1 12/2002 Costa
6,511,562 B1 1/2003 Coffield
6,561,605 B1 5/2003 Akers
6,871,921 B2 3/2005 Ernst
6,913,156 B1 7/2005 Wolff
6,928,711 B1 8/2005 Sunka
6,938,784 B2 9/2005 Yang
6,948,788 B1 9/2005 Tai
(Continued)

*Primary Examiner* — James O Hansen
(74) *Attorney, Agent, or Firm* — Oyen Wiggs Green & Mutala LLP

(57) ABSTRACT

A drawer structure including a front end, a rear end and the side walls, the front end having a panel front and a crossbar in which a gap between the panel front and the crossbar permits the insertion of an insert or the passage of a fabric material whereby a basket may be secured in a drawer frame. Where a fabric material is passed between the panel front and the crossbar it may be wrapped around the crossbar and inserted into an inward facing recess of the crossbar whereby the material may be secured by the tension applied by the weight of the basket causing a crossbar clip to splay and prevent the fabric from being dislodged from the recess.

10 Claims, 24 Drawing Sheets

(56) References Cited

U.S. PATENT DOCUMENTS

| | | | |
|---|---|---|---|
| 7,147,120 | B2 | 12/2006 | Rosenberg et al. |
| 7,197,888 | B2 | 4/2007 | LeClear et al. |
| 7,434,951 | B2 | 10/2008 | Bienick |
| 7,540,576 | B1 | 6/2009 | Ross |
| 7,540,577 | B2 | 6/2009 | Netzer |
| 7,556,317 | B2 | 7/2009 | Bottemiller |
| 8,695,306 | B2 | 4/2014 | Cvek |
| 8,696,079 | B1 | 4/2014 | Solo |
| 8,764,137 | B2 | 7/2014 | Fehre |
| 8,833,881 | B2 | 9/2014 | Manniso et al. |
| 8,931,862 | B2 | 1/2015 | Grimm |
| 9,033,435 | B2 | 5/2015 | Gasser |
| 9,060,605 | B2 | 6/2015 | Gasser |
| 9,131,771 | B2 | 9/2015 | Lindblom |
| 9,169,640 | B2 | 10/2015 | Jeffers et al. |
| 9,468,293 | B2 | 10/2016 | Yang |
| 2018/0132616 | A1 | 5/2018 | Salice |

* cited by examiner

FIG. 11
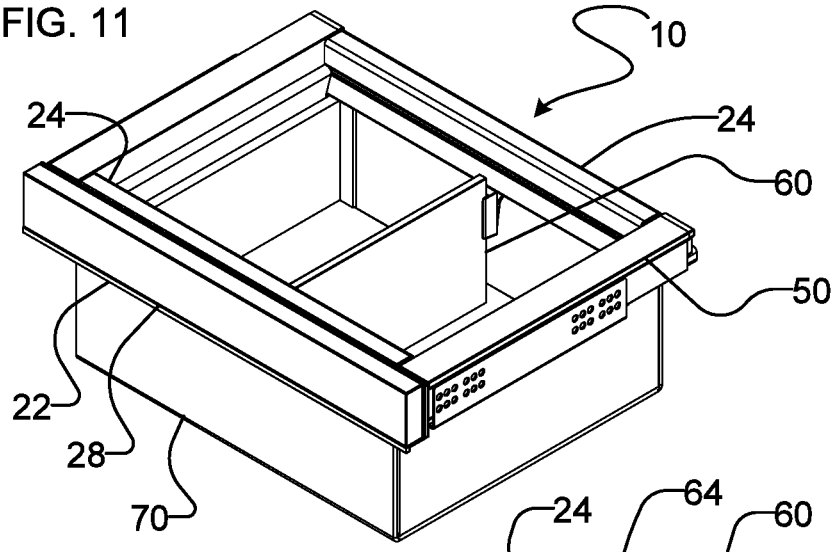
FIG. 12
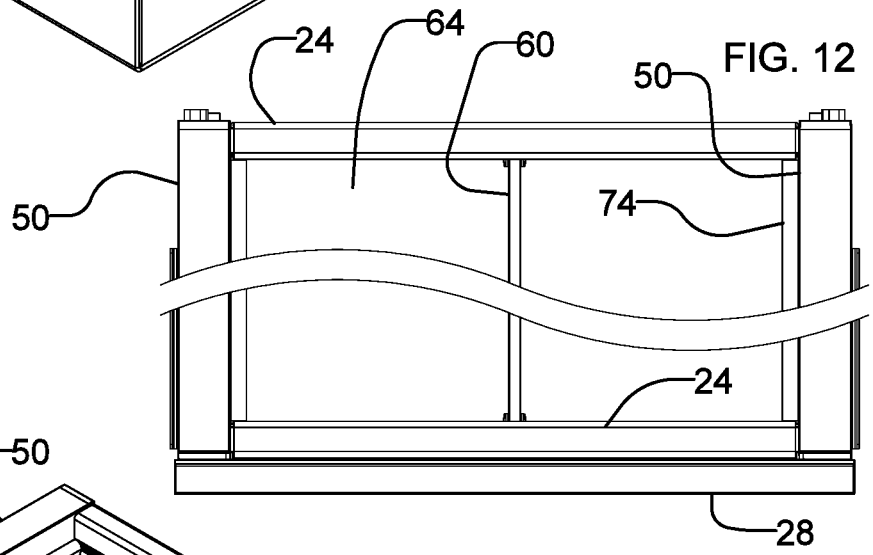
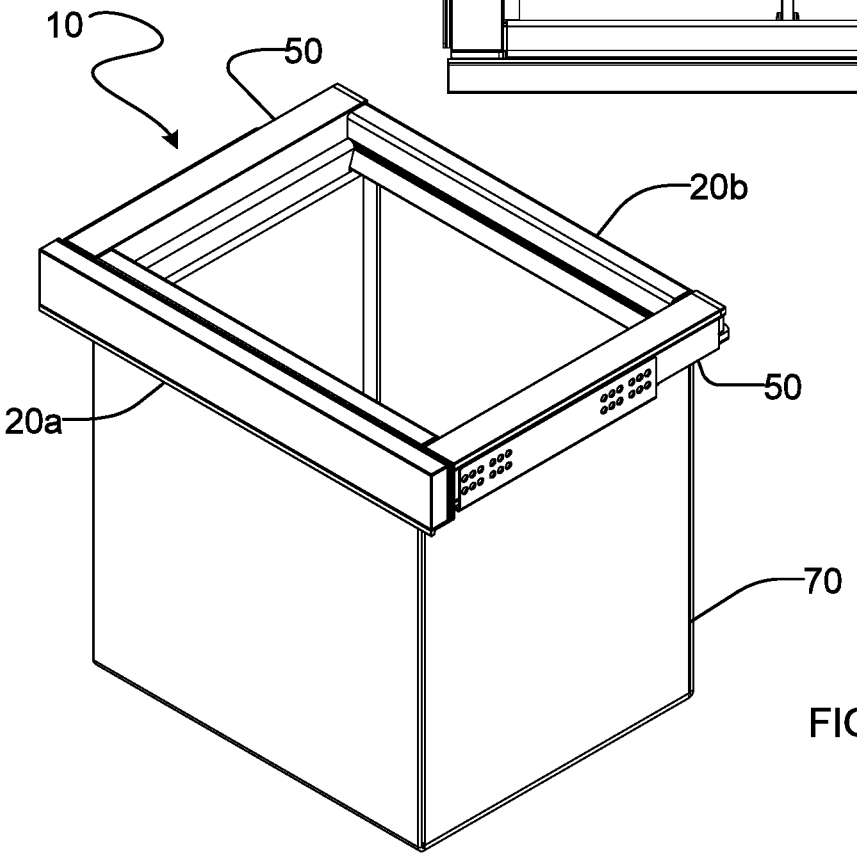
FIG. 13

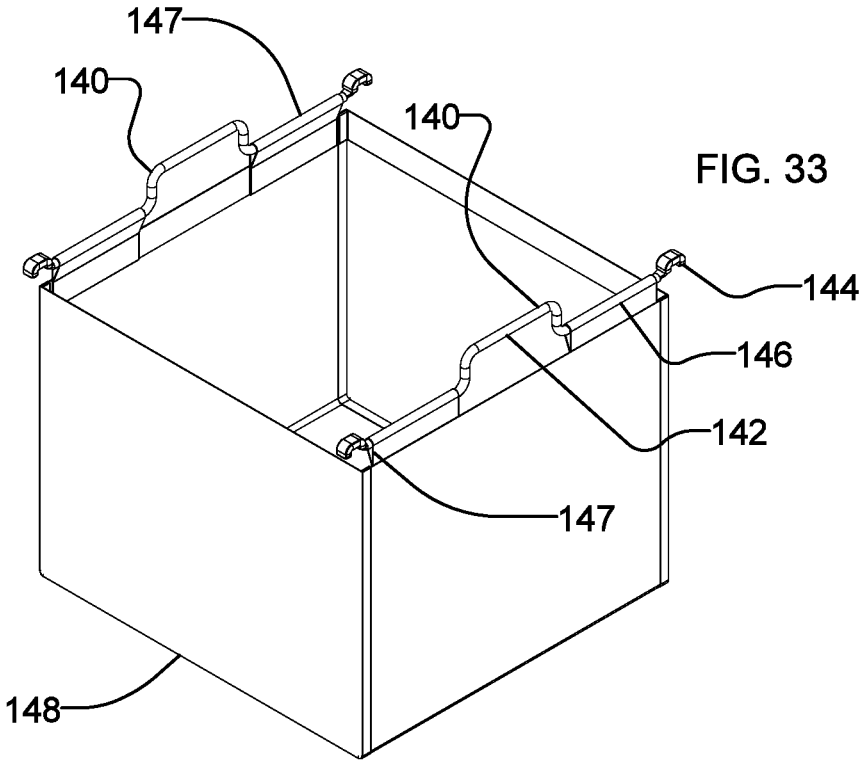
FIG. 33
FIG. 34
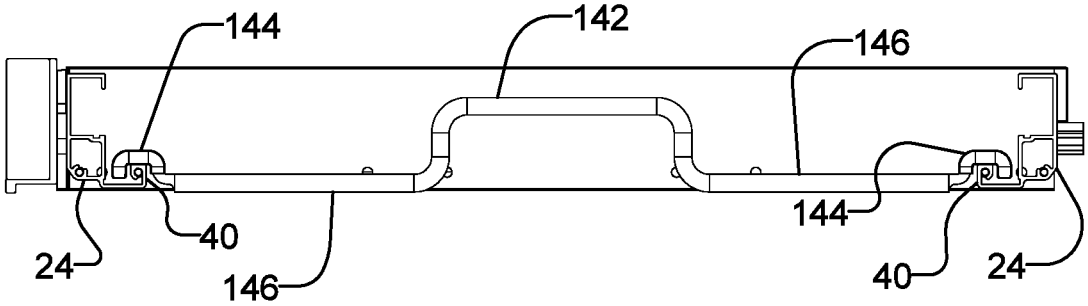
FIG. 35
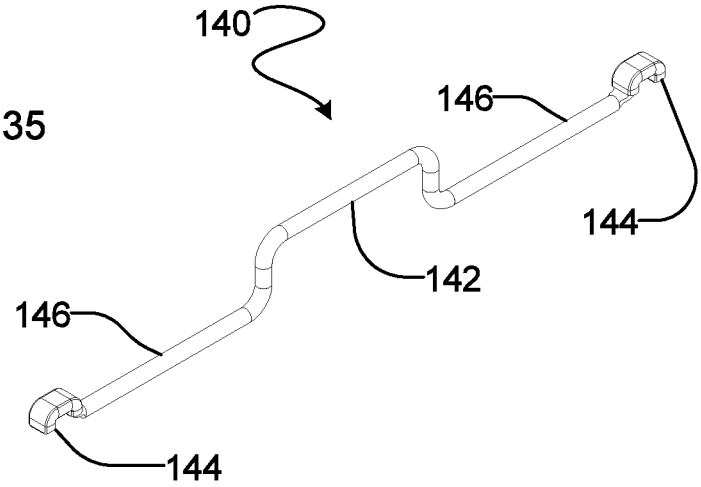

DRAWER SYSTEM

TECHNICAL FIELD

This invention relates to drawers for closets, cabinets and the like, and in particular, drawers accommodating one or more ornamental or functional elements including glass panels, decorative panels, fabric or leather containers, compartment dividers and racks.

BACKGROUND

Drawers of many designs are known in the art. A conventional drawer in a closet, cupboard, desk or other types of furniture will have front, rear and side walls, and may have a compartment containing a rigid base, a flexible basin, or a rack.

In some known drawers one or more walls of the drawers may be configured to receive a decorative cover, insert or other ornamental attachment. In some such drawers the front panel of the drawer may include a glass section permitting a user to see into the drawer.

In some closet systems a variety of specialized drawers may be desired. For example, such a closet may provide a drawer for jewelry storage, a drawer that is designed for lingerie storage, a drawer that provides a pant organizer, and a drawer that provides a laundry hamper.

Within the prior art, various parts used to construct each drawer may not typically be interchangeable between variants of the drawers, i.e. a given variant of a drawer construction might require a number of dedicated parts. In order to be able to fulfill orders for any of a variety of drawer variants it may therefore be necessary to stock a significant number of parts for each type of drawer being sold. It can therefore be advantageous to have components that may be interchangeable across multiple variants of drawers and include parts that may serve multiple functions across the multiple variants. This versatility of the components may permit increased efficiency in storage because fewer parts may need to be kept on hand to be able to produce the same variety of assembled drawers.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a drawer frame panel comprising a panel front and a crossbar disposed parallel to the panel front, the crossbar comprising a top wall, a front wall and a floor, the top wall, front wall and floor together defining an internally-facing recess, wherein the panel front and crossbar are secured together to leave a gap across substantially an interior length of each of the panel front and crossbar and the gap is sized to receive one or more of a rigid insert or a fabric material.

A further aspect of the invention provides a drawer frame comprising a panel front; front and rear crossbars, the crossbars each comprising a top wall, a front wall and a floor, the top wall, front wall and floor together defining an internally-facing recess; and a first side bar and a second side bar, each of the first side bar and second side bar having first ends connected to respective ends of the front crossbar and second ends connected to respective ends of the rear crossbar, wherein the panel front and crossbar are secured together to leave a gap across substantially an interior length of each of the panel front and crossbar, and the gap is sized to receive one or more of a rigid insert or a fabric material.

A further aspect of the invention provides a method of securing a basket in a drawer including the steps of providing a drawer frame comprising a panel front and a crossbar, each of the panel front and crossbar aligned in parallel and connected at each end to leave a gap between panel front and crossbar, the crossbar comprising front, top and bottom walls defining an inwards facing recess; providing a basket comprising at least one edge, the edge having a front loop; passing the loop through the gap between the panel front and crossbar; inserting a rod into the front loop; inserting the front loop into a crossbar clip; and securing the crossbar clip in the inwards facing recess.

In yet another embodiment of the invention, there is provided a drawer including a panel front, a front crossbar, the front crossbar including a top wall, a front wall and a floor, the top wall, front wall and floor together defining an inwards-facing recess; the drawer further including a rear crossbar and a first side bar and a second side bar, each of the first side bar and second side bar having first ends connected to respective ends of the front crossbar and second ends connected to respective ends of the rear crossbar, wherein the panel front and front crossbar are secured together to leave a gap across substantially an interior length of each of the panel front and front crossbar, the gap configured to receive one or more of a rigid insert or a fabric material.

In some aspects of this embodiment, there may be further included: a basket, the basket having a front edge, a rear edge, two side edges, and a front loop extending upwards from the front edge of the basket, the front loop passing through the gap between panel front and front crossbar, passing over the front crossbar and inserted into the recess in the front crossbar; a rod and crossbar clip, the rod inserted into the front loop, and the front loop and rod inserted into a rod channel in the crossbar clip wherein insertion of the front loop into the recess in the front crossbar comprises the crossbar clip, front loop and rod being inserted together into the crossbar recess; the front crossbar further including a recess channel in the floor and the crossbar clip further including a ridge, and upon insertion of the crossbar clip into the crossbar recess the crossbar clip ridge engages the recess channel to further secure the crossbar clip within the crossbar recess.

In further aspects of this embodiment, there may be further included: the rear crossbar including a rear crossbar top wall, a rear crossbar front wall and a rear crossbar floor, the rear crossbar top wall, rear crossbar front wall and rear crossbar floor together defining an inwards-facing rear crossbar recess and the basket further including a rear loop extending upwards from the rear edge of the basket, the rear loop inserted into the rear crossbar recess; a second rod and second crossbar clip, the second rod inserted into the rear loop, and the rear loop and inserted second rod are inserted into a second rod channel in the second crossbar clip, the second crossbar clip inserted into the rear crossbar recess; the rear crossbar floor including a rear crossbar recess channel and the second crossbar clip further includes a ridge and upon insertion of the second crossbar clip into the recess of the rear crossbar the second crossbar clip ridge engages the rear crossbar recess channel to further secure the crossbar clip within the rear crossbar recess.

In some aspects of this embodiment the panel front may be fastened to the first and second side bars through first and second side bar spacers; a width of the gap between the panel front and the front crossbar may be substantially defined by the thickness of the side bar spacers; the basket may further comprise side loops extending upwards from the side edges of the basket, and side loop rods may be inserted in the side loops, each of the side loop rods comprising first and second rods ends engaging the front and rear crossbar recesses respectively; the side loop rods may comprise metal rods; the drawer may include a rigid insert inserted into the gap between the panel front and the front crossbar, and the rigid insert may be a glass insert; the first and second side bars may include first and second side bar spacers attached at the front of each side bar respectively, each of the first and second side bar spacers comprising an angled shoulder, wherein the panel front is fastened to the first and second side bars through the first and second side bar spacers, and wherein the rigid insert rests upon the angled shoulders of the side bar spacers when inserted into the gap between the panel front and the front crossbar; and the drawer may further comprise one or more internal crossbars, each internal crossbar having first and second ends fastened to an internal wall of first and second side bars respectively, and one or more slats, each slat having at least a first end and a second end wherein each of the first and second ends engage either an internal crossbar, the front crossbar or the rear crossbar to provide a floor for the drawer.

In some further aspects of the invention the drawer may further comprise: internal crossbars attached at each end to the side bars; dividers suspended between front and rear crossbars, the dividers held at each end by divider clips secured in the crossbar recesses; a hamper suspended by a pair of handles, each handle having a first and a second end, the first end resting upon a foot of the front crossbar and the second end resting upon a foot of the rear crossbar; a garment organizer including organizer rods suspended between front and rear crossbars or suspended between the side bars; a shoe rack comprising one or more horizontal bars held by a pair of rack side walls, the rack side walls engaging the rear crossbar and a short internal crossbar to secure the rack side walls in an upright position; one or more slats engaging the front and rear crossbars to support one or more inserts, the one or more inserts comprising one or more of a U-shaped divider, a watch pillow, and a ring holder.

In a yet further embodiment of the invention there is provided a drawer comprising a panel front, a front crossbar, the front crossbar secured to the panel front to leave a gap across substantially an interior length of each of the panel front and front crossbar, the gap configured to receive one or more of a rigid insert or a fabric material, a rear crossbar, a first side bar and a second side bar, each of the first side bar and second side bar having first ends connected to respective ends of the front crossbar and second ends connected to respective ends of the rear crossbar, and a drawer basin. In some aspects of this embodiment the front crossbar may include a recess and the drawer basin may comprise a basket, the basket comprising front, rear and side edges and a front loop extending from the front edge of the basket, the front loop passing through the gap between panel front and front crossbar, and passing over the front crossbar and inserted into the recess in the front crossbar. In other aspects of this embodiment the drawer basin may comprise one or more slats and at a front end of the basin the slats may engage the front crossbar and at a rear end of the basin the slats may engage the rear crossbar.

In a further embodiment of the invention, there is provided a method of securing a basket in a drawer the method comprising providing a drawer frame having a panel front and a crossbar, each of the panel front and crossbar aligned in parallel and connected at each end to leave a gap panel front and crossbar, the crossbar having front, top and bottom walls defining an inwards facing recess, providing a basket having at least one edge, the edge having a front loop, inserting a rod into the front loop, inserting the front loop into a crossbar clip, passing the crossbar clip through the gap between the panel front and crossbar, and securing the crossbar clip in the inwards facing recess. In a further embodiment, the drawer frame has a rear crossbar and the basket further has at least a second edge, the second edge having a rear loop, and the method further involves inserting a rod into the rear loop inserting the rear loop into a crossbar clip and securing the crossbar clip in the inwards facing recess.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

FIG. 11 shows an isometric view of an assembled drawer variant having only one divider.

FIG. 12 is a disconnected top view of an assembled drawer according to the embodiment shown in FIG. 11.

FIG. 13 is an isometric view of an assembled drawer variant having an elongated basket.

FIG. 33 is an isometric view of the hamper of the drawer hamper shown in FIG. 30 with the hamper shown separate from the drawer frame.

FIG. 34 is cross-section of the drawer frame and handle of the hamper in an assembled configuration.

FIG. 35 is an isometric view of the handle of the hamper of FIGS. 30-34.

DESCRIPTION

Figure 1:
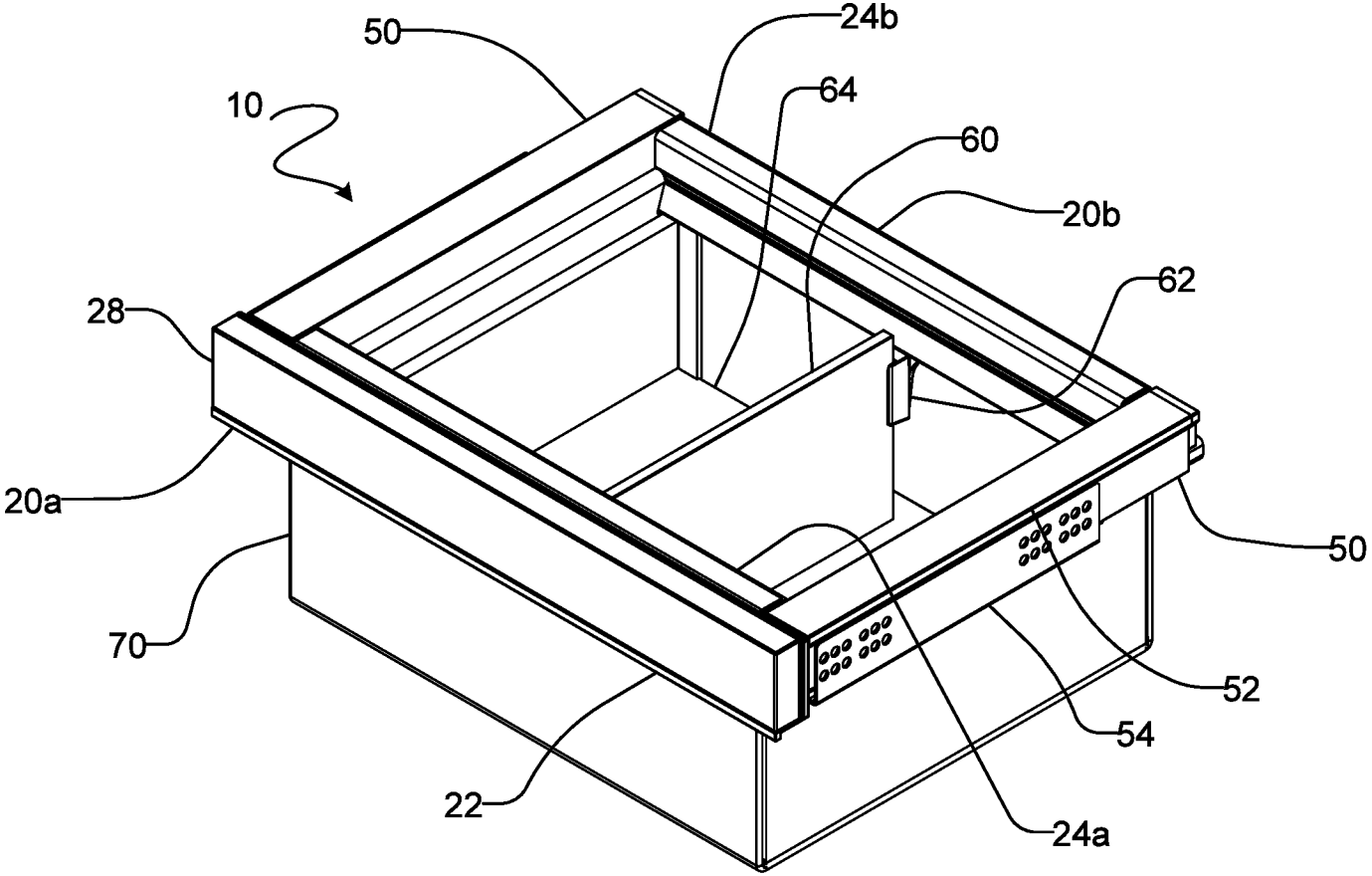
FIG. 1 is an isometric view of an assembled drawer having a basket defining a basin, and dividers forming two compartments within the basin.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

A table listing each reference numeral with its associated element is provided here.

Table of Reference Numerals

| | |
|---|---|
| 10 | Drawer |
| 20 | Front and rear ends |
| 20a | Front end |
| 20b | Rear end |
| 22 | Panel front |
| 24 | Crossbar |
| 24a | Front crossbar |
| 24b | Rear crossbar |
| 26 | (Glass) insert |
| 28 | Drawer face |
| 30 | Crossbar front side |
| 31 | Crossbar top side |
| 32 | Downward tongue |
| 33 | Floor |
| 34 | Channel |
| 35 | Recess |
| 37 | Protrusion |
| 38 | Hook segment |
| 39 | Cavity |
| 40 | Crossbar foot |
| 42 | Hollow subsection |
| 44 | Screw holes |
| 50 | Side bars |
| 52 | Side bar slide cover |
| 54 | Side bar slide |
| 56 | Side bar spacer |
| 60 | Dividers |
| 62 | Divider holders |
| 63 | Divider holder tab |
| 64 | Basket floor |
| 65 | U-shaped divider |
| 65b | Narrow U divider |
| 66 | (Tall) int. crossbar |
| 67 | Short int. crossbar |
| 68 | Rigid floor/slats |
| 69 | Crossbar insert |
| 70 | Basket |
| 72 | Front loop |
| 73 | Rear loop |
| 74 | Side loops |
| 76 | Rods |
| 76a | Front and rear rods |
| 76b | Side rods |
| 80 | Crossbar clip |
| 81 | Clip top side |
| 82 | Clip front side |
| 83 | Receded edge |
| 84 | Rod channel |
| 85 | Hooks |
| 86 | Clip ridge |
| 90 | Int. crossbar feet |
| 92 | Int. crossbar walls |
| 120 | Front upward wall |
| 122 | Side upward wall |

-continued

| Table of Reference Numerals | |
|---|---|
| 123 | Holes |
| 124 | Rear upward wall |
| 126 | (Tall) dividers |
| 130 | Divider clip |
| 132 | Vertical groove |
| 134 | Clip upper section |
| 136 | Clip ridge |
| 140 | Hamper handle |
| 142 | Handle portion |
| 144 | Handle hooks |
| 146 | Handle rods |
| 147 | Hamper loops |
| 148 | Hamper |
| 150 | Organizer rod |
| 152 | Rod portion |
| 154 | Claw portion |
| 156 | Garment clips |
| 160 | Upper rack |
| 162 | Rack side walls |
| 164 | Horizontal bar |
| 170 | Watch pillow |
| 172 | Ring holder |
| 174 | Generalized organizer |

Turning now to the accompanying drawings, FIG. 1 shows a drawer 10 including front and rear ends or panels 20*a* and 20*b* (collectively 20) and side bars or side walls 50 which assembled together provide a rigid frame for supporting the drawer 10. While in the following embodiments side bars 50 are shown comprising a slide arrangement in which each side bar 50 comprises a slide cover 52 and slide 54, the mechanism for extension of the drawer compartment out of the furniture or enclosure in which it is normally contained in its retracted position may comprise any of a number of widely known slide or rail configurations. For example, the extension mechanism may comprise ball-bearing drawer slides, under mounted slides, so-called 'European slides', or other mechanisms known in the art.

The front and rear ends 20*a* and 20*b* and side bars 50 of the embodiment shown in FIG. 1 together provide a frame from which a flexible container, such as a basket or bag 70, may be suspended. Drawer front end comprises principally a panel front 22 and front crossbar 24*a*. Drawer rear end 20*b* comprises a crossbar 24*b*. In this and following embodiments the front and rear crossbars 24*a* and 24*b* are identical in construction (though reversed in orientation within the frame). However, it is conceived that front and rear crossbars 24*a* and 24*b* could comprise different parts. For the remainder of this description the crossbars 24*a* and 24*b* will be described collectively as crossbars 24 but it should be understood that the front crossbar 24*a* might in some embodiments differ in construction from the rear crossbar 24*b*. The basket 70 may be made of leather, artificial leather, textiles or any of various other fabric-like materials. While the basket material will hereafter be referred to as being a fabric, it should be understood that the basket may be made of any of a variety of sufficiently flexible and tough materials.

Figure 2:
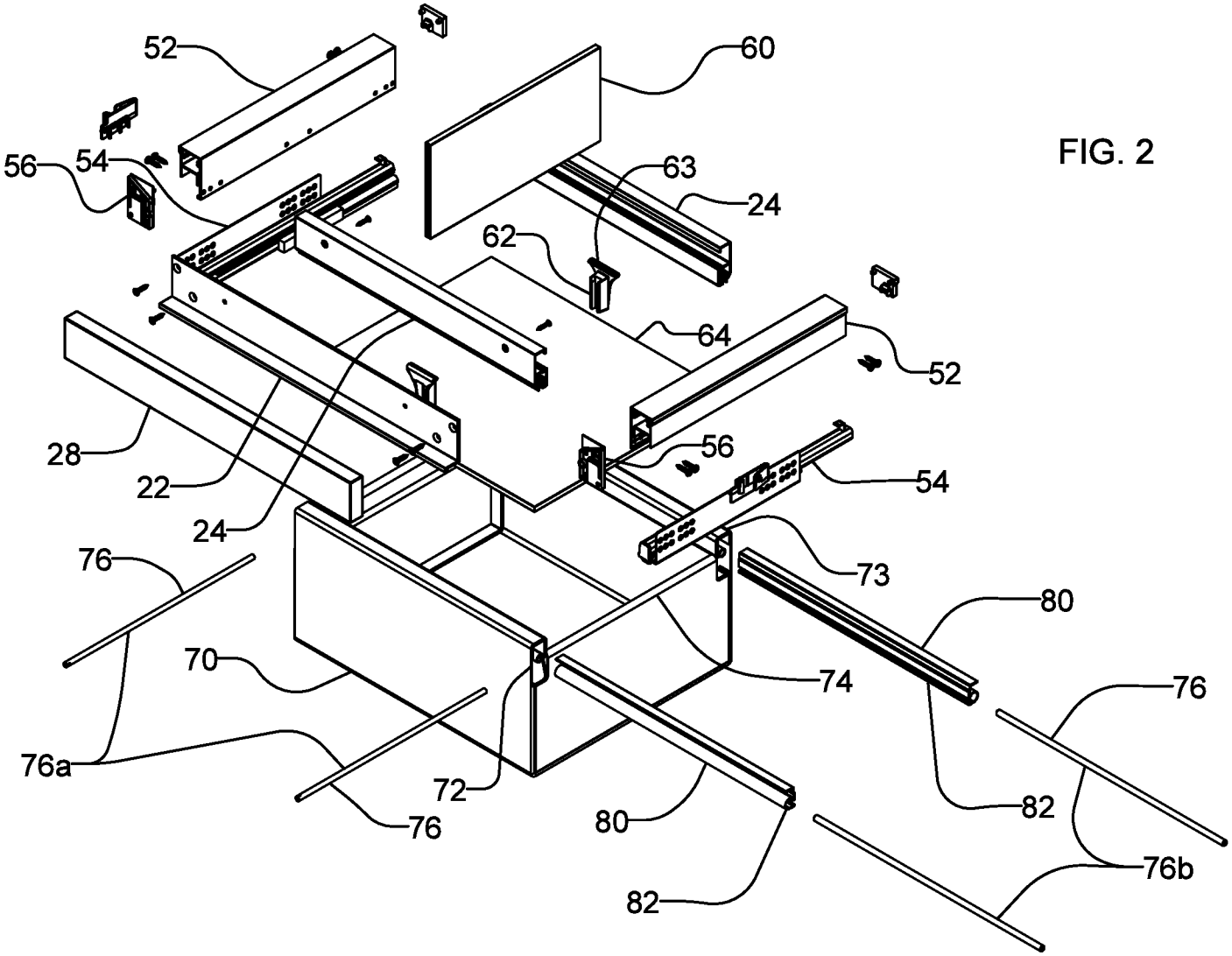
FIG. 2 shows an exploded view of the drawer of FIG. 1.

FIG. 2 shows an exploded view of the drawer 10 of FIG. 1. To assemble the drawer the panel front 22 is aligned in parallel with crossbar 24, leaving a small gap between the panel front 22 and the crossbar 24. The panel front 22 and the crossbar 24 are then fastened at each end to front ends of the side bars 50. In the embodiment shown the panel front 22 and crossbar 24 are each independently attached to each side bar 50, with panel front 22 being fastened to an end of the side bar 50 through the side bar spacer 56 and crossbar 24 being fastened to a sidewall of the side bar 50 adjacent the end of the bar. The front side of crossbar 24 and the front end of side bars 50 may be aligned such that the thickness of side bar spacer 56 substantially defines the width of the gap. In the embodiment shown, screws pass entirely through crossbar 24 and secure panel front 22 to drawer face 28. In some embodiments screws or other fasteners may be inserted through crossbar 24, panel front 22 and into drawer face 28 to secure each these components together. The connections between the panel front 22, crossbar 24 and side bars 50 may be arranged in various configurations. For example, the crossbar 24 may be secured to the panel front 22 and drawer face 28, and the panel front 22 be secured to the side bar 50 with no direct connection or fastener connecting the crossbar 24 to the side bar 50. While screws are shown in the figures, various fasteners and other means of fastening are known in the art and may be used to secure the parts together. For example, in some embodiments components may be secured by an adhesive, or may be held by pressure applied by two connected adjacent parts. In some embodiments the panel front 22 and the crossbar 24 may be integral, connected across one or more of their ends and forming a single component, i.e. a monolithic component.

Figure 3:
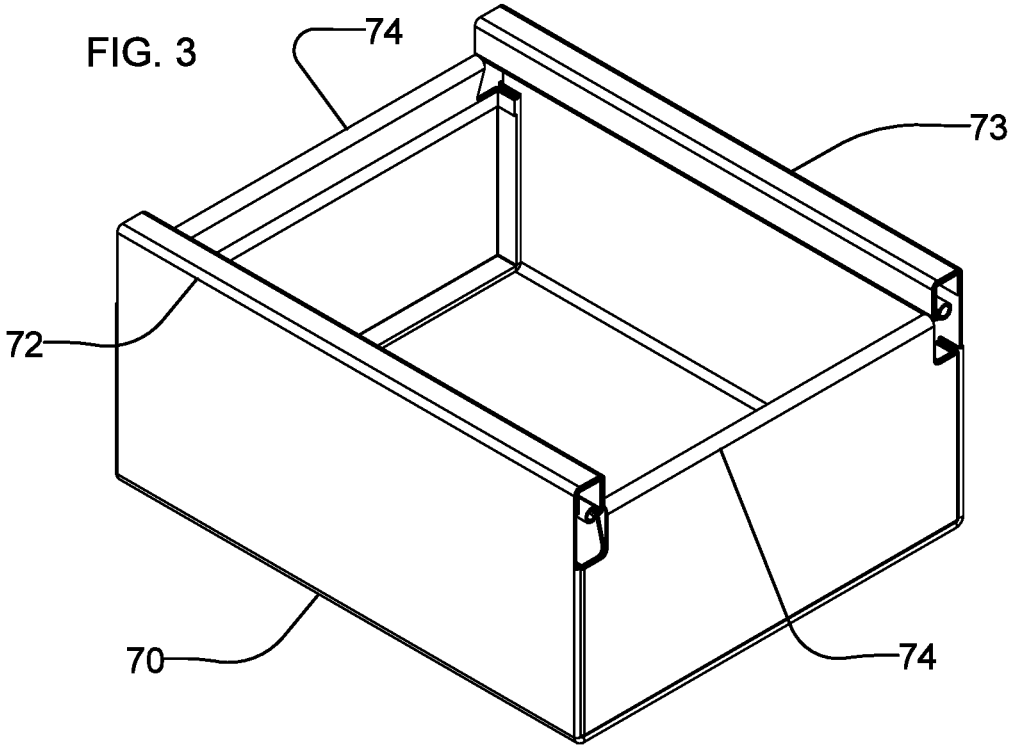
FIG. 3 shows an isometric view of the basket as shown in FIG. 1 in its assembled configuration.
Figure 4:
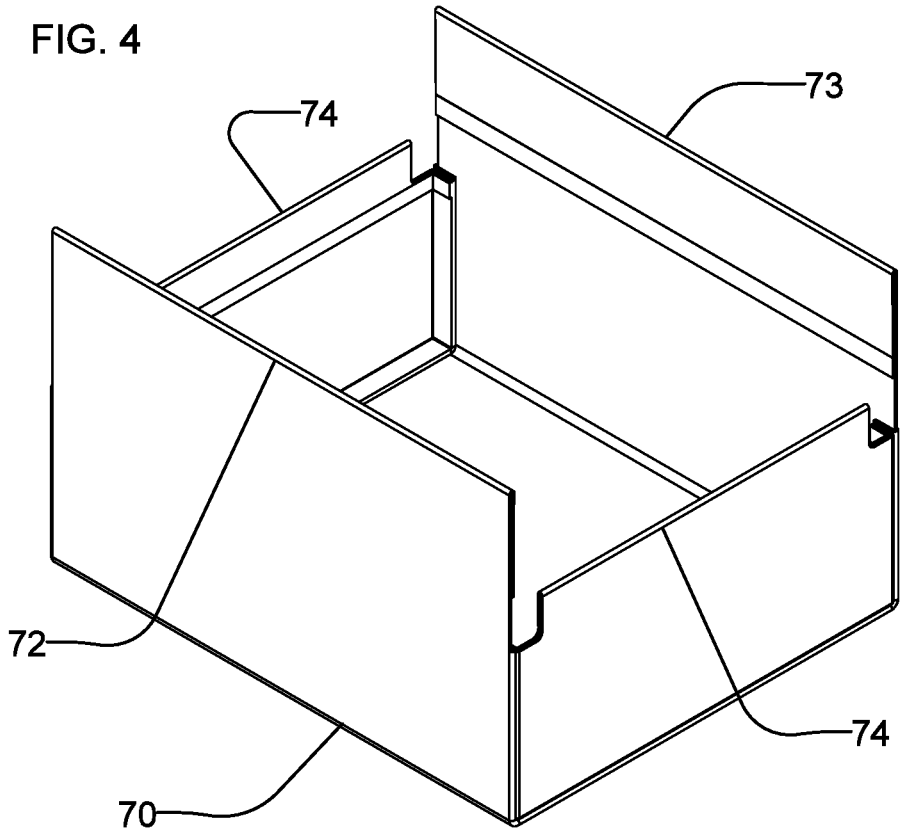
FIG. 4 shows an isometric view of the basket as shown in FIG. 1 with the front, rear and side loops unravelled.

Basket 70 has front, rear and side walls with each wall terminating at the top edge in a loop of fabric, as shown in greater detail in FIGS. 3 and 4. In FIG. 3, the basket is shown in the configuration it would take in an assembled drawer. While basket 70 is shown having the shape of a rectangular prism with an open top, the shape of the basket could vary. For example, the basket may take the shape of an inverted polygonal dome. In the present embodiment, the front, rear and side and bottoms walls are each defined by a rectangular length of fabric, with each length of fabric secured to the adjacent length of fabric at their respective edges. In the embodiment described here the seams of adjacent sections of fabric are stitched together at the edges. Before the assembly of the complete drawer, the basket may be stored separately and folded so that only the side walls crease during the folding. This may protect the front and rear walls of the basket from becoming creased which improves the appearance of the basket when in its assembled configuration.

As shown in FIG. 4, a loop of fabric may be provided by taking an edge of the fabric and folding it back into its corresponding wall to form the loop. The loop of fabric may be secured by sewing, gluing, stapling, or otherwise securing the edge of the fabric to the wall. In some embodiments there may be provided only a front loop. Further embodiments, such as those shown here, may include rear and side loops. Into each of front, rear and side loops 72, 73, and 74 a rod 76 may be inserted to provide structural rigidity. Rods 76 are shown with a circular cross-section but may have other cross-sections or may have cross-sections that vary over the length of the rod, and may be made of a variety of materials such as plastics or metals. For example, as shown in FIG. 2, the rods 76A inserted into the front and rear loops may be made from PVC and may have a smaller cross-section than the rods 76B inserted into the side loops, which may have a larger cross-section and may be made from steel to provide additional rigidity to suspend the sides of the basket.

In the case of loops 72 and 73, the loops, with rods 76 inserted, may be fitted into rod channels 84 of crossbar clips 80, each described in greater detail below with respect to FIGS. 5-8. The basket may be divided into a plurality of compartments using dividers 60 and divider holders 62, as shown in FIGS. 1 and 2. A basket floor 64 may be inserted into the basket to provide structural rigidity at the bottom of the basket and to hold the walls of the basket apart. The basket floor 64 may be rectangular in shape, but other shapes may be used. In embodiments in which the bottom end of the basket may have non rectangular shapes, such as for an inverted polygonal dome, the basket floor 64 may be shaped to conform to the shape of the basket. The basket floor 64 may be made from any of a variety of materials of sufficient rigidity to provide structure to the bottom of the basket, such as cardboard, wood or other materials.

Figure 5:
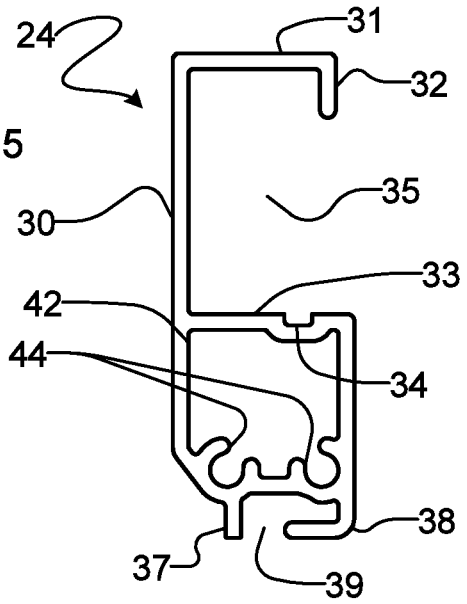
FIG. 5 is a side view of a crossbar of the embodiment shown in FIG. 1.
Figure 8:
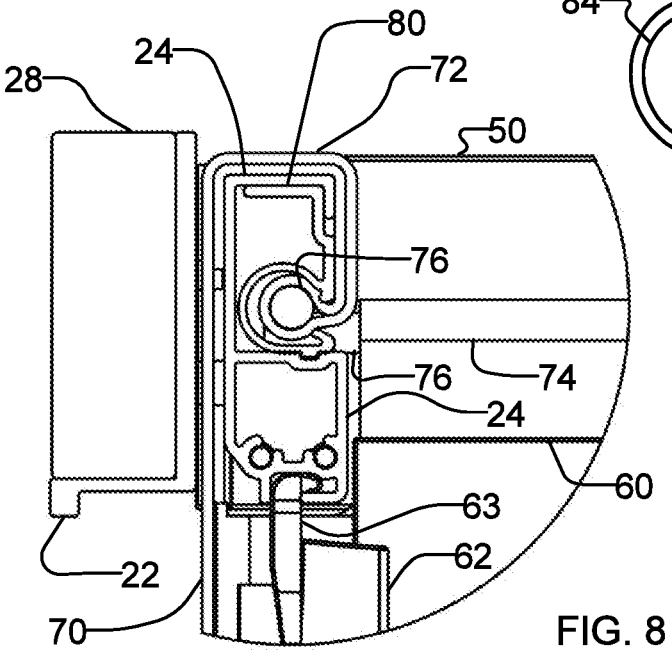
FIG. 8 is a side view of the front of an assembled drawer according to the embodiment shown in FIG. 1.
Figure 9:
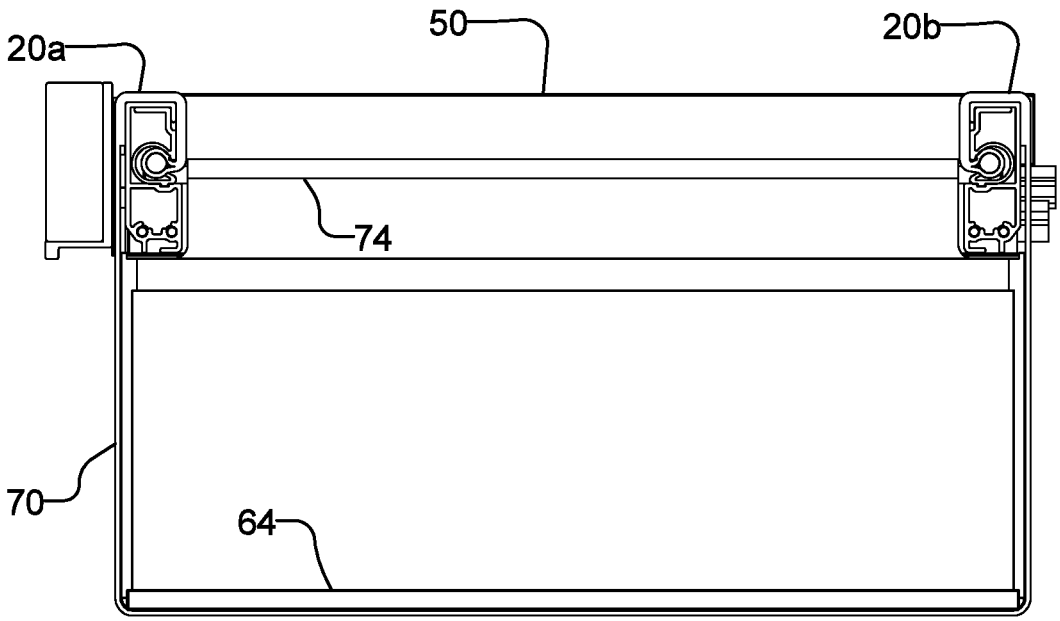
FIG. 9 is a side view cross-section of an assembled drawer according to the embodiment shown in FIG. 1.

Referring now to FIG. 5, there is shown a side view of a crossbar 24 according to the present embodiment. Crossbar 24 comprises a front side 30, a top side 31 extending horizontally inwards away from the top end of front side 30 and ending in a downwardly extending tongue 32, extending for some or all of the length of the crossbar 24. Crossbar floor 33 extends horizontally inwards away from front side 30 and may include a channel 34 in the floor 33 extending for some or all of the length of the crossbar 24. Front side 30, top side 31 and floor 33 collectively define three walls of a recess 35. Crossbar 24 may include a hollow subsection 42 which may provide rigidity while keeping the crossbar light. In some embodiments, a protrusion 37 and a hook segment 38 each extend downwards from the hollow subsection 42. The protrusion 37 and hook segment 38 define a cavity 39 for receiving a tab 63 of divider holders 62. As shown in FIG. 8, the crossbar protrusion 37 and hook segment 38 provide a cavity 39 for insertion of a divider holder tab 63, by which divider holders 62 can be suspended from the bottom end of crossbars 24.

Figure 6:
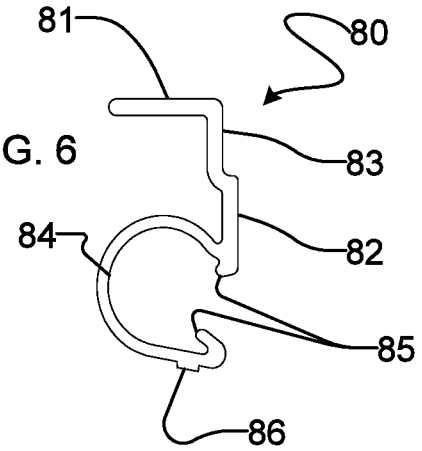
FIG. 6 is a side view of a crossbar clip of the embodiment shown in FIG. 1.
Figure 7:
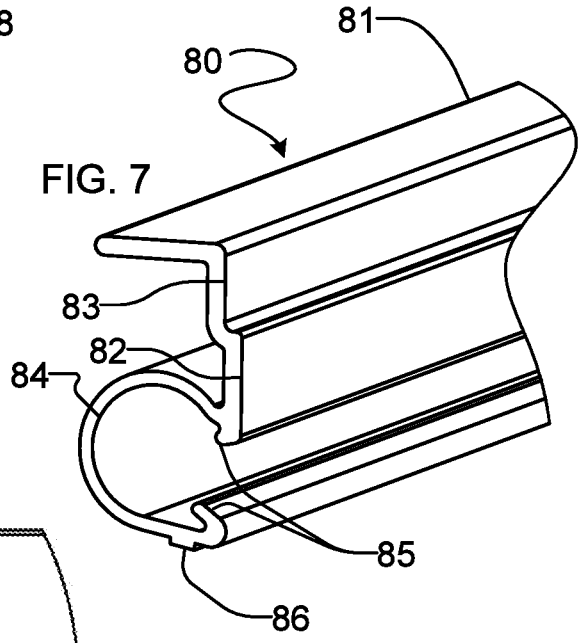
FIG. 7 is an interrupted isometric view of a crossbar clip of the embodiment shown in FIG. 1.

Crossbar clip 80 is shown in FIGS. 6 and 7. The crossbar clip 80 has a top side 81, and a front side 82, including a partially receded front edge 83. The partially receded front edge 83 is receded from the clip front 82 by a distance that is approximately the width of crossbar tongue 32. This may permit the crossbar clip 80 to engage smoothly with the inwards facing side of the crossbar 24 once inserted into the crossbar recess 35. The front side 82 ends in a rod channel 84 comprising a substantially circular passage with an opening on the inwards facing side, adjacent to where the front side 82 meets the rod channel 84. At each end of the opening there may be crossbar clip hooks 85. During the assembly of the drawer of the present embodiment the gap between the crossbar 24 and panel front 22 provides space for front loop 72 to pass between the crossbar and panel front, and then up and over the top side 31 of crossbar 24, Rods 76 are then inserted into loops 72, 73 and 74 and the loops 72 and 73 are fitted over the top side 81, over the front side 82, and the inserted into rod channels 84 of their respective crossbar clips. At the front crossbar, the loop 72, rod 76, and crossbar clip 80 are then inserted together into the recess 35 of crossbar 24, as shown in FIG. 8. A clip ridge 86 of crossbar clip 80 engages channel 34 of crossbar 24, to secure the crossbar clip 80 within the recess 35. At the rear end of the drawer, loop 73 within rod channel 84 may be similarly pulled up and over the rear side of crossbar 24*b* and inserted and secured into recess 35 of crossbar 24.

When tension is applied to the basket 70, the rods 76 are caught within rod channels 84 of crossbar clips 80. The opening in the rod channels 84 on the inward-facing side of the crossbar clips 80 is sufficiently small that the combination of the loop of fabric and rod together are not able to pass through the opening without the forcing the opening to widen. However, within the recess 35 there is insufficient space for the opening to be widened due to each of the top side 81 of the crossbar clip 80 and the ridge 86 fitting against the top side 31 and channel 34 of the crossbar, respectively. Consequently, to the extent that the tension applied through the fabric to the rods forces the opening to widen, this causes the clip hooks 85 of the crossbar clip 80 to splay outwards, thereby applying greater force into channel 34 and the corner of crossbar top side 31 and crossbar tongue 32, further securing the crossbar clip 80 within crossbar 24. To remove a fabric loop 72, 73 and crossbar clip 80 from a crossbar 24 it may be necessary to either disassemble the drawer frame so as to allow the crossbar clip 80 to be slid lengthwise out of the crossbar recess 35, or to make use of a specialized tool to disengage the crossbar clip ridge 86 from the recess channel 34. The specialized tool may comprise a thin hook that is inserted in the space between the loop 72 and the lower of the two crossbar clip hooks 85. The thin hook (not shown) can then catch the lower crossbar clip hook 85 and be manipulated to lift the crossbar clip 80 so that crossbar clip ridge 86 disengages crossbar channel 34, thereby allowing removal of the crossbar clip from the crossbar.

Figure 10:
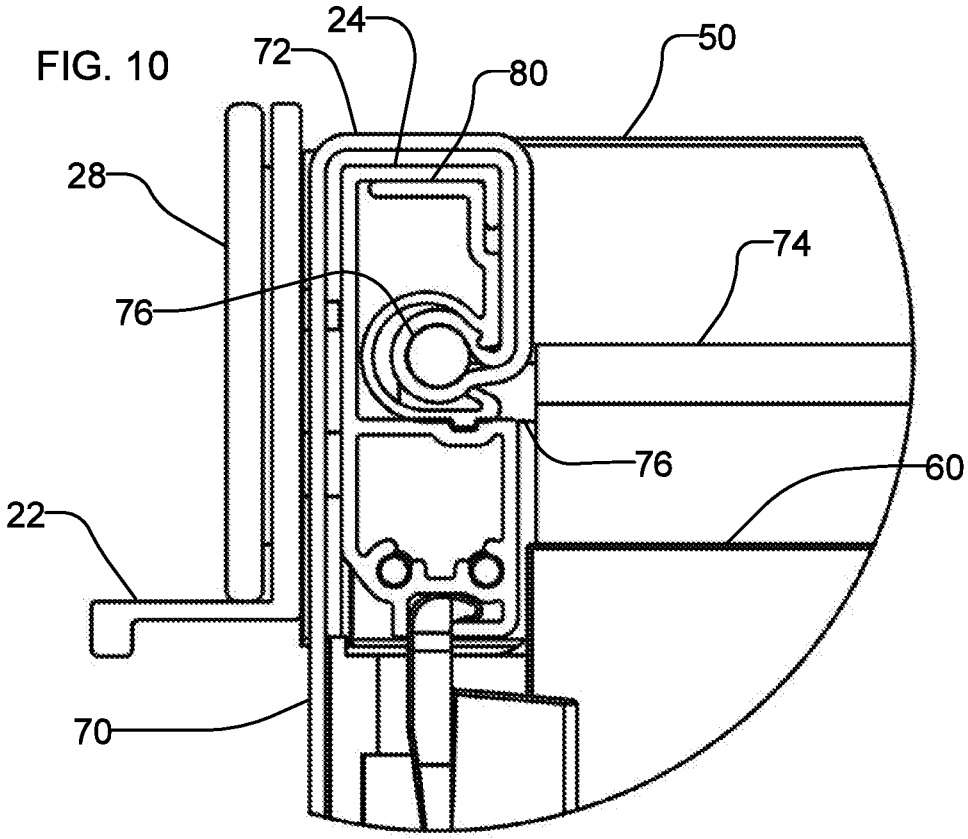
FIG. 10 shows a side view of the front of an assembled drawer variant having a thin drawer face.

The side loops 74, with rods 76 inserted, may sit alongside the internal faces of side bars 50. The walls of the basket may be separated towards the top of each wall to permit the loops to move with some degree of independence. In some embodiments, the front and back ends of rods 76 in side loops 74 may rest in the crossbar recesses 35 of the front and rear crossbars 24*a* and 24*b* respectively, as shown in in FIG. 10.

A decorative drawer face 28 may also be attached to panel front 22. As shown in FIG. 2 the panel front may be attached to the panel front by screws or similar fasteners countersunk into the components from the inwards facing side. The components may be attached or fastened by a variety of means such as adhesives, or discrete clamps at each end of the panel front. The drawer face 28 may take a variety of shapes and materials. For example, the drawer face may have a thickness that conforms to the length of the bottom of panel front 22 as shown in FIG. 8, or may be thin, permitting the bottom edge of panel front 22 to project outwards from the drawer front. In some further embodiments an insert (such as the glass insert 26 shown in FIGS. 14 and 15) may also be inserted into the gap between panel front 22 and front crossbar 24, resting in front of the loop of fabric 72 pulled through the gap and over the front crossbar 24.

FIGS. 11, 12 and 13 show some variant embodiments of a drawer comprising a basket. In FIG. 11 there is shown a variant of a basket drawer with only one divider 60. FIG. 12 shows an interrupted top view of the embodiment shown in FIG. 11. The top view shows how Side loops 74 of the basket rest on the interior edge of side bars 50. FIG. 13 shows a variant of the drawer with a basket of extended length.

Figure 14:
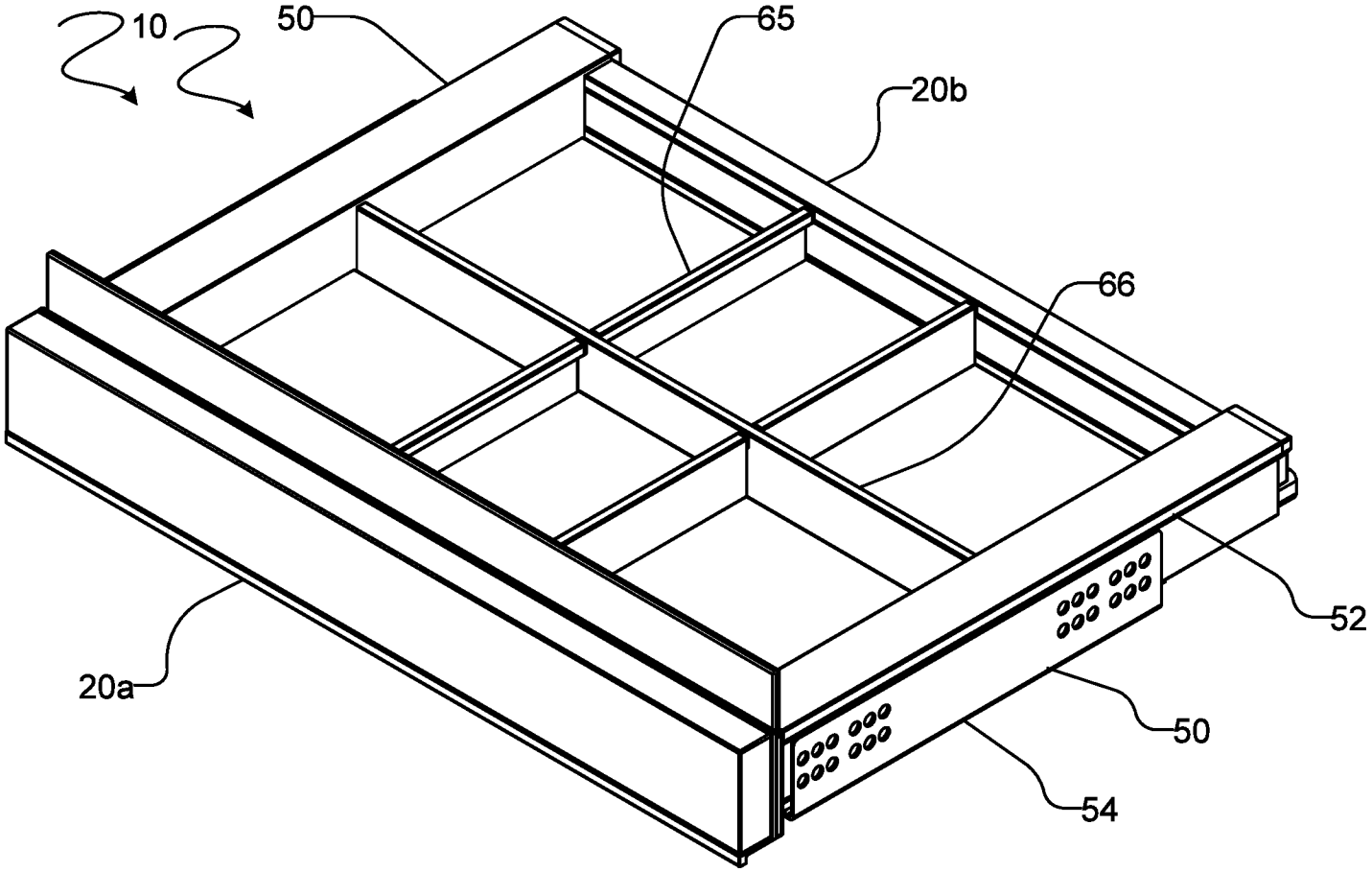
FIG. 14 shows an isometric view of an assembled drawer having bottom panels and a glass insert.
Figure 46:
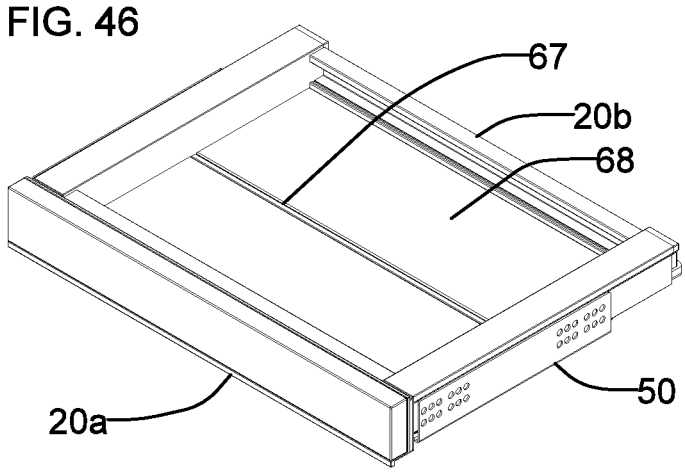
FIG. 46 is an isometric view of an embodiment of the drawer having slats and a single short internal crossbar.

FIG. 14 shows an embodiment in which the drawer frame supports a shallow rigid drawer with compartments. Various compartments in the drawer are defined by a plurality of U-shaped dividers 65 and an internal crossbar 66; however, many means of defining compartments within a drawer are known in the art and may be used. For example, a number of inserts that can define sections of a drawer are shown in FIGS. 49-52. In another example not shown in the following embodiments a number of compartments may be defined by a single integral insert. Alternatively, the drawer may have only a single compartment defined by a rigid floor (provided by one or more large slats 68) with the walls provided by the front and rear ends 20 and side bars 50, as shown in FIG. 46.

Figure 15:
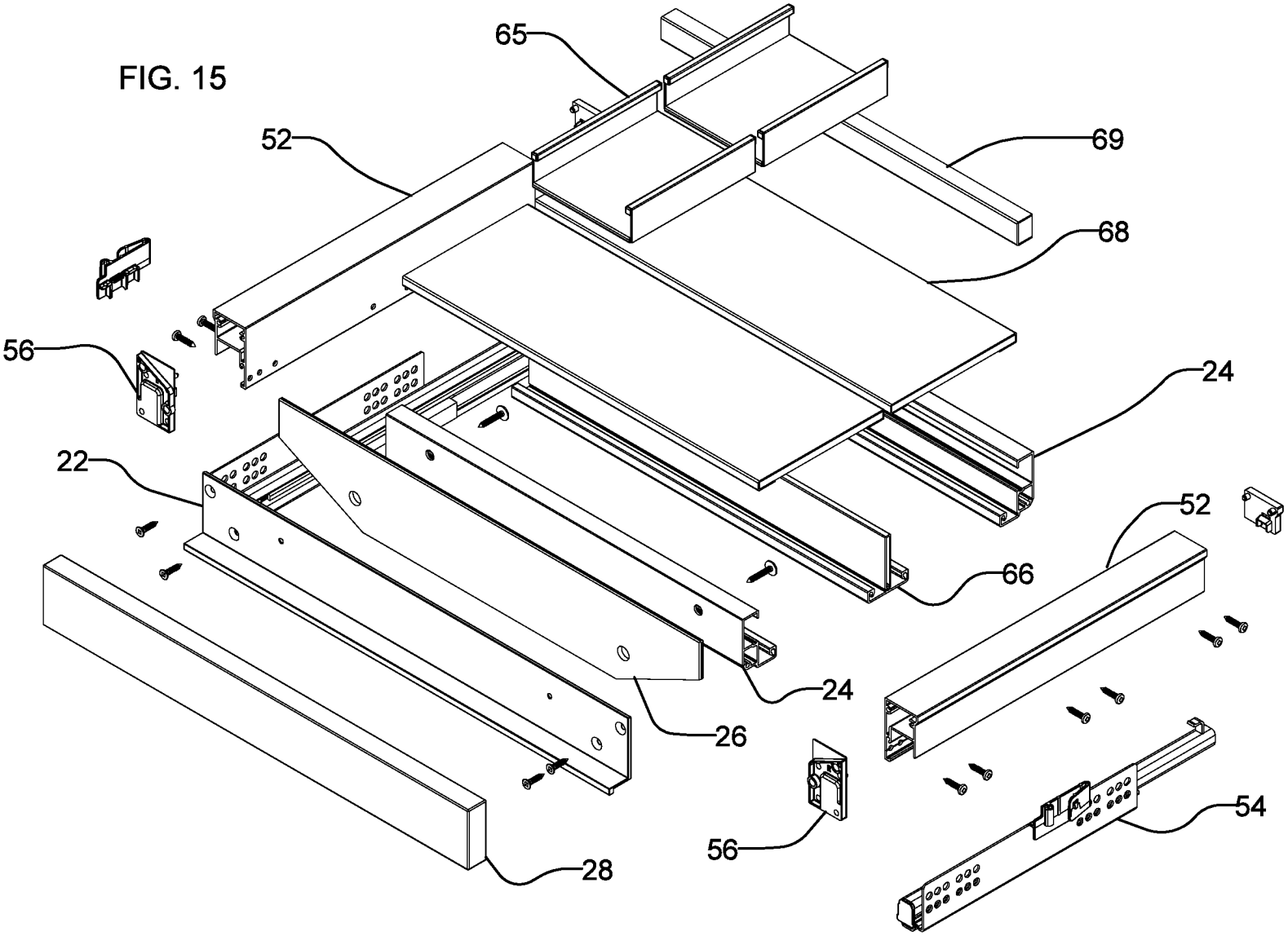
FIG. 15 is an exploded view of the embodiment shown in FIG. 14.

Turning to FIG. 15, there is shown an exploded view of an embodiment similar to that shown in FIG. 14. In this embodiment in addition to crossbar 24 and panel front 22, the drawer front also comprises an insert 26 and drawer face 28. The insert 26 and drawer face 28 are in this embodiment primarily ornamental in function and can be made in a variety of shapes and configurations and could be made out of a variety of materials. In the embodiment as shown the insert 26 may be made of clear glass, or some other transparent or translucent material, though non-translucent materials could also be used. The drawer face 28 might be made from wood, metal, ceramic, stone or other materials or combinations of materials. In further variations of this embodiment either of the insert 26 or the drawer face 28 may be omitted entirely.

To assemble the drawer of this embodiment, the panel front 22, crossbar 24, and side bars 50 are configured as previously described in relation to FIG. 2. The insert 26 may then be inserted into the gap between panel front 22 and crossbar 24. The insert 26 may partially rest on shoulders provided by the side bar spacer 56 and a drawer face 28 may be attached to the panel front 22. The shoulders of side bar spacer 56 may be angled to assist in centering the insert 26 within the gap between the panel front 22 and crossbar 24, so that that the ends of the insert 26 are centered relative to the ends of the panel front 22 when the drawer is assembled. Screws or other fasteners can then be inserted through crossbar 24, insert 26 and panel front 22 and into drawer face 28 to secure these components together.

Figure 16:
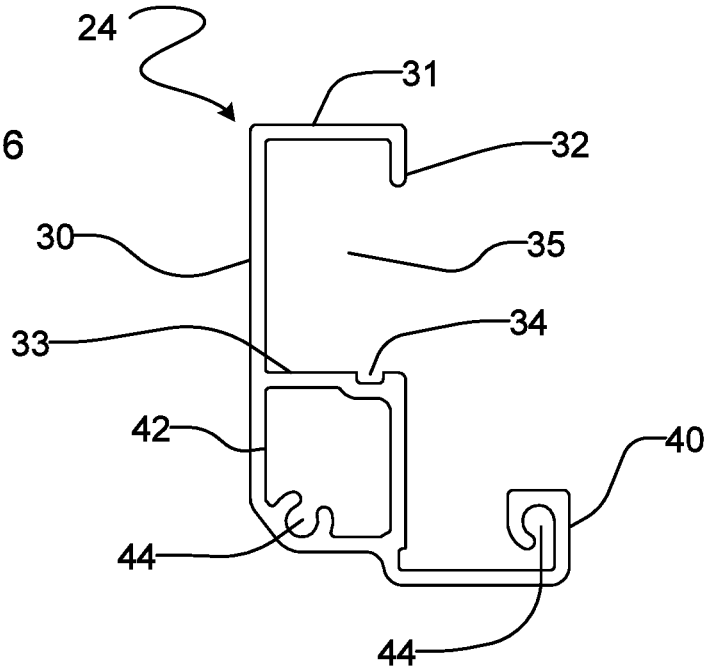
FIG. 16 is a side view of a crossbar of a drawer of the embodiment shown in FIG. 14.
Figure 17:
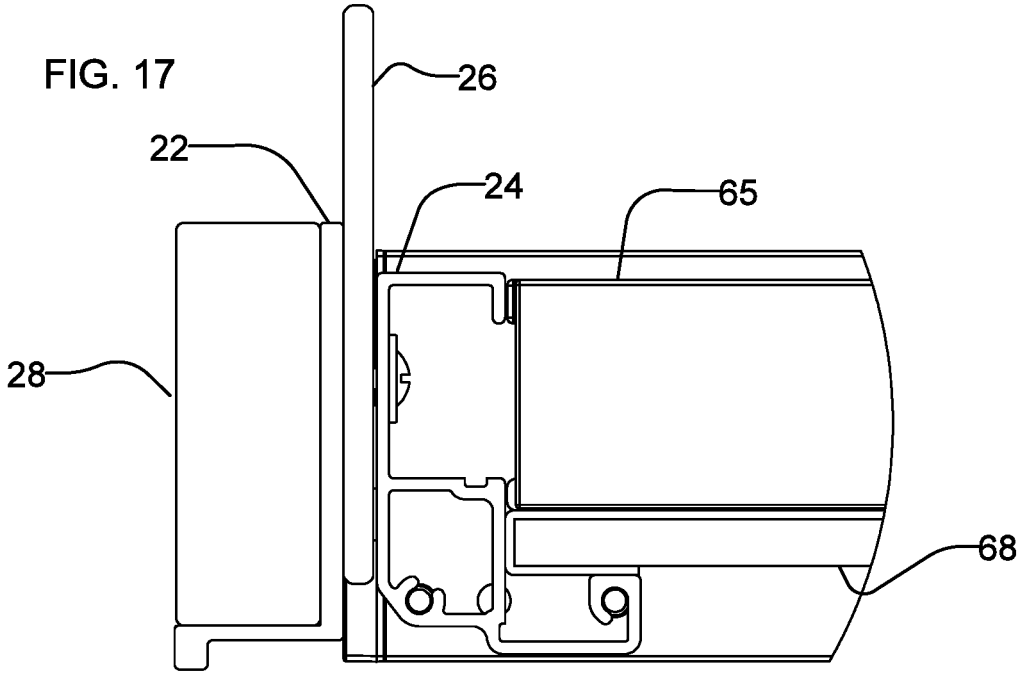
FIG. 17 is a side view of the front of an assembled drawer according to the embodiment shown in FIG. 14.

Referring now to FIGS. 16 and 17, there are shown side views of the crossbar 24 and a cross-section of the front of a drawer 10 of the present embodiment. The crossbar 24 of this embodiment differs from the crossbar of the embodiment shown in FIGS. 1-13 in the construction of the bottom portion of the crossbar. Instead of having a protrusion and hook segment extending downwardly from the hollow subsection 42, in this embodiment the crossbar 24 comprises a foot 40 extending horizontally away from front side 30. The foot 40 can provide a surface on which drawer components, like slats 68, may rest. The foot may also provide one or more at least partially enclosed holes 44 to receive screws at which the crossbar 24 may be fastened to side bar 50. One or more slats 68 can provide a floor for the drawer compartments and may provide a base on which U-shaped dividers 65 can be placed.

In some embodiments there may be included one or more internal crossbars 66. Internal crossbars can be attached to the drawer frame through the side bars 50 and may have internal crossbar feet 90 which provide support for slats 68. Internal crossbars 66 may also have internal crossbar walls 92 that can serve to define compartments of the drawer in combination with the U-shaped dividers 65, as shown in FIG. 14.

Figure 18:
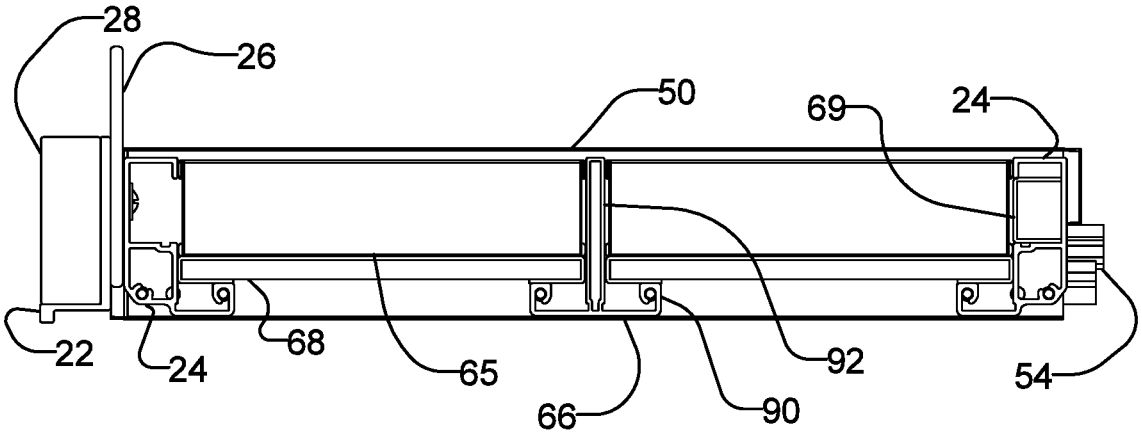
FIG. 18 is a side cross-section of an assembled drawer according to the embodiment shown in FIG. 14
Figure 19:
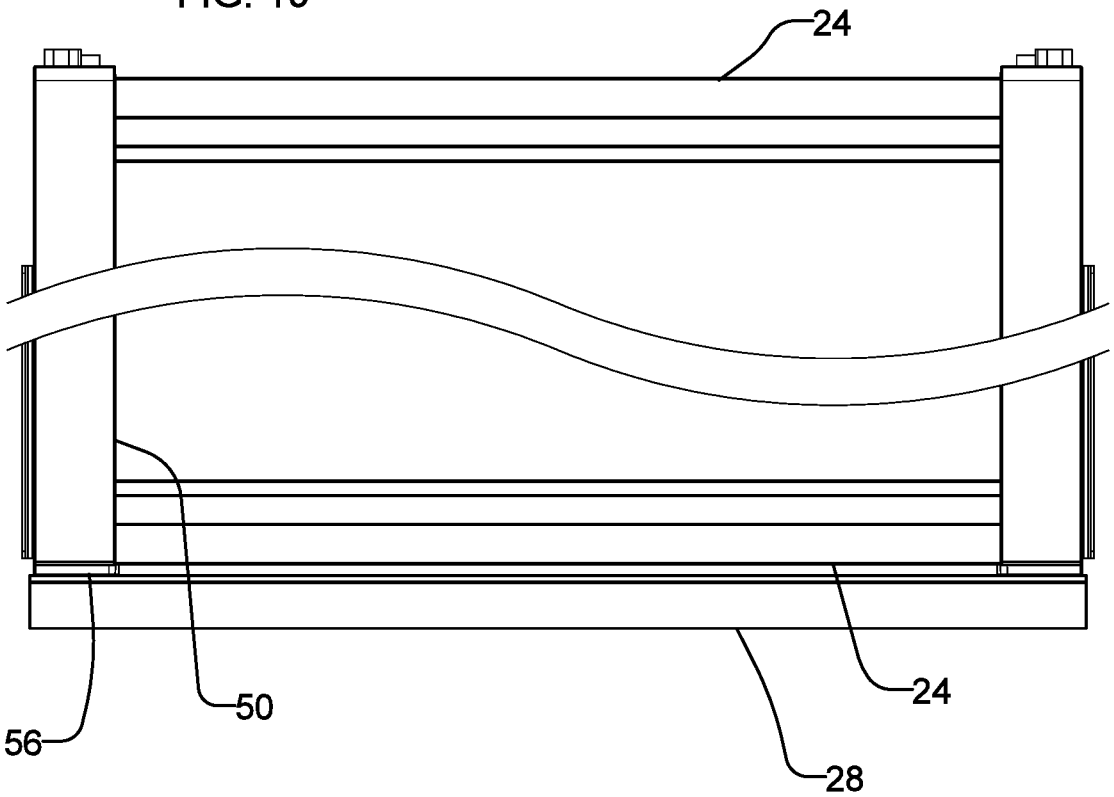
FIG. 19 is an interrupted top view of a partially assembled drawer according to the embodiment shown in FIG. 14, shown without slats or insert.
Figure 20:
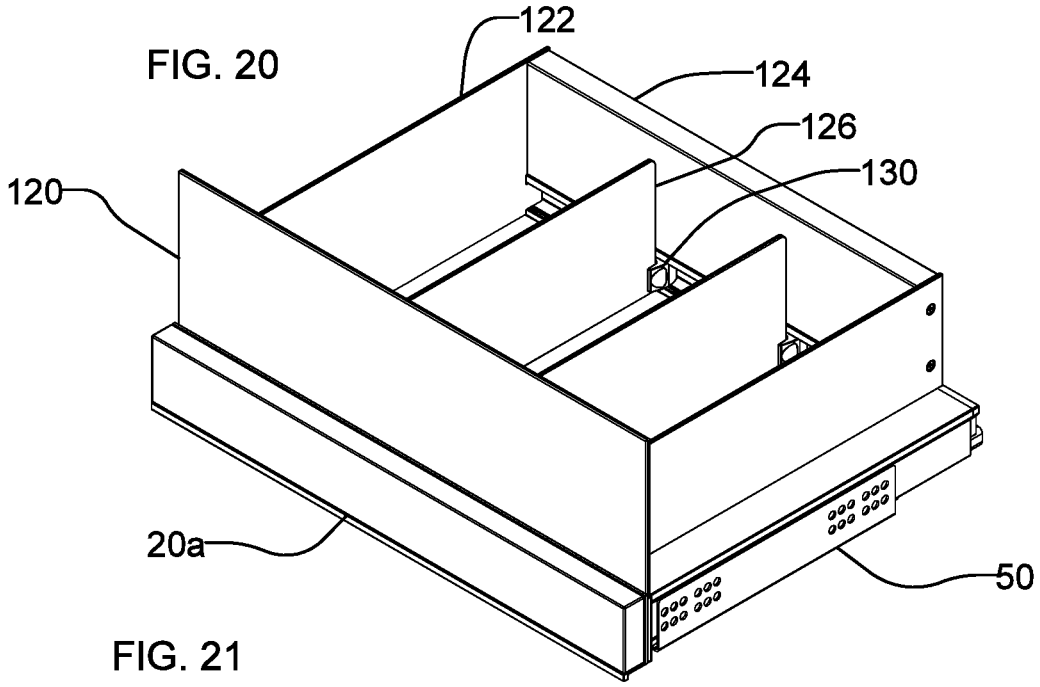
FIG. 20 is an isometric view of an embodiment of the drawer having tall front, side, and rear walls.

FIG. 18 shows a side cross-section of the drawer of the embodiment shown in FIG. 14. This cross-section shows how the insert 26 fits cleanly into the gap between panel front 22 and crossbar 24. Also shown in this figure are slats 68 resting on crossbars 24 and internal crossbar 66. On top of the slats rest the U-shaped dividers 65. In the rear crossbar a crossbar insert 69 fills the crossbar recess. The insert may be decorative and may be sized to fit within the recess 35 and be secured within the recess by crossbar tongue 32. The crossbar insert 69 may also have a protrusion (not shown) which engages channel 34 in floor 33 to further secure the insert within the crossbar recess. FIG. 19 shows a disconnected top view of a drawer without U-shaped dividers, internal crossbars or slats.

Figure 21:
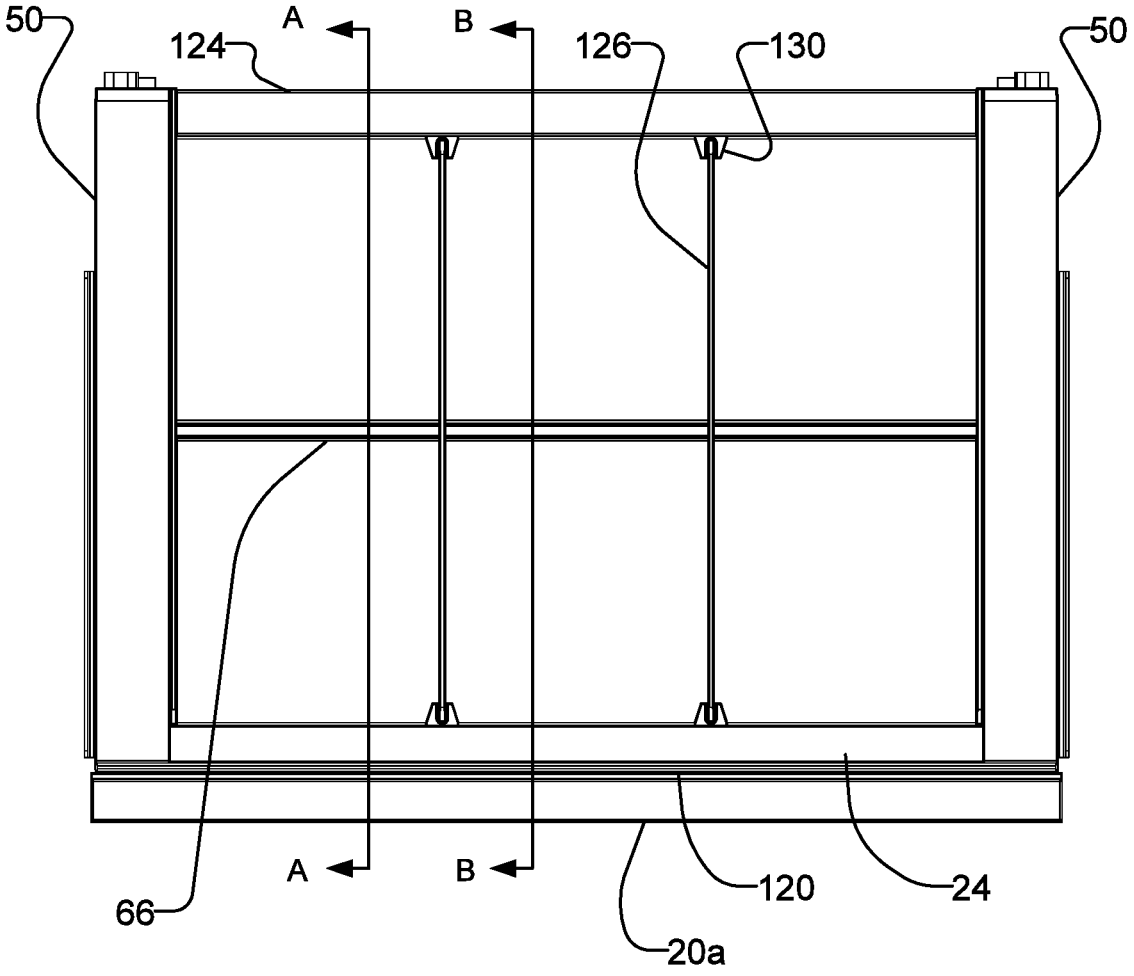
FIG. 21 is a top view of the embodiment of the drawer shown in FIG. 20.
Figure 22:
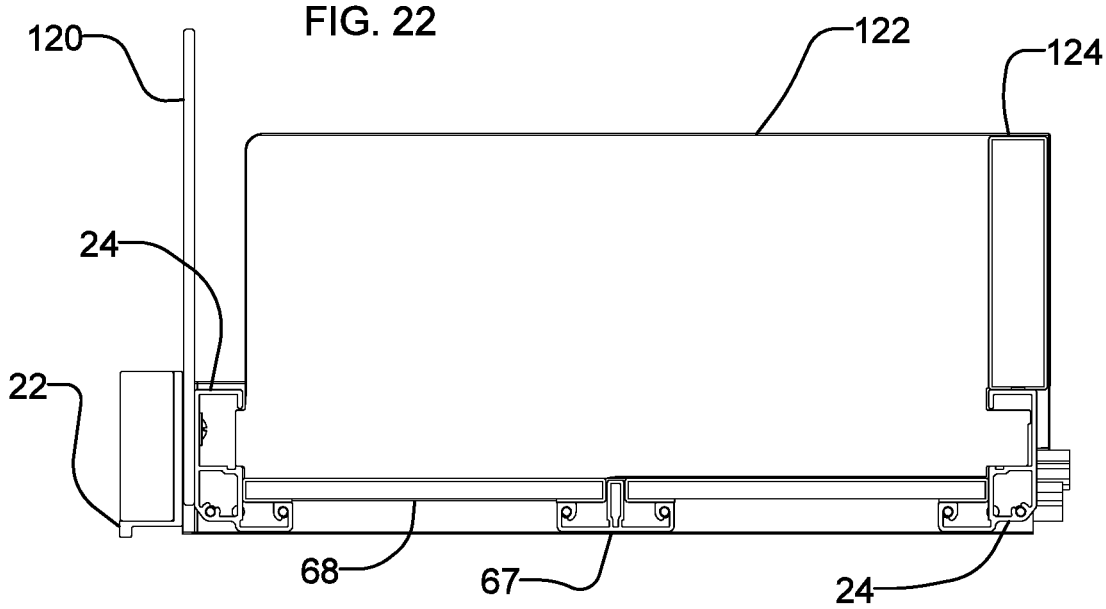
FIG. 22 is a cross-section taken through the plane A-A in FIG. 21.
Figure 23:
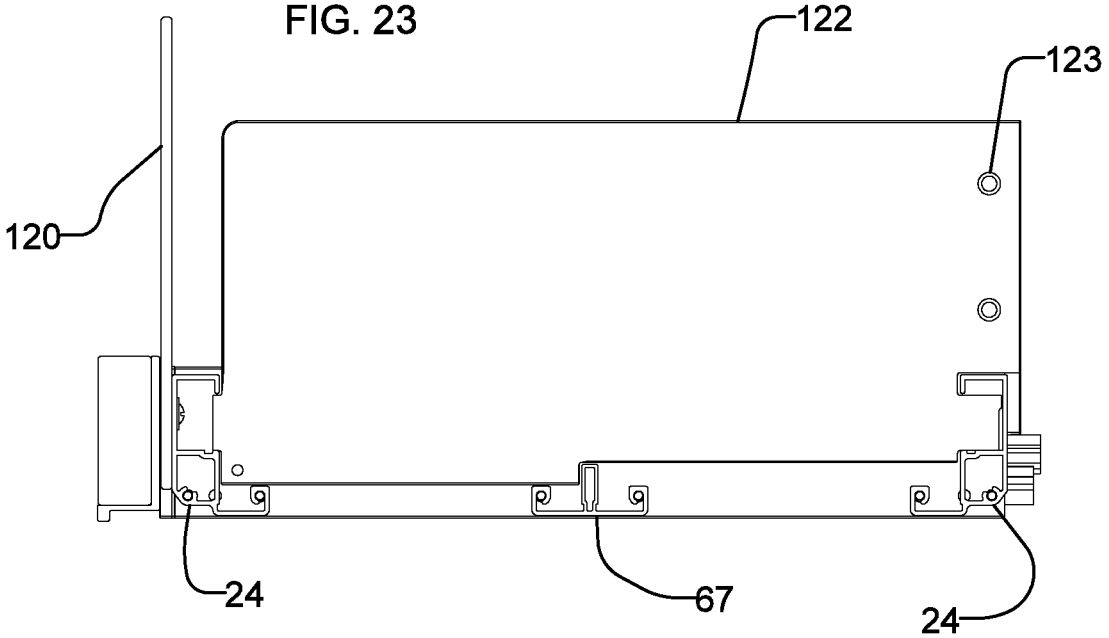
FIG. 23 is a cross-section taken through the plane A-A in FIG. 21 in which the slats and rear upward wall are hidden.

In some embodiments a drawer may further comprise walls extending upwardly from the rigid frame, as shown in FIGS. 20-33. In such embodiments, the drawer includes one or more front upward wall 120, side upward walls 122 and rear upward wall 124. The front upward wall may comprise a tall glass insert similar to the glass insert 26. The drawer may further include dividers 126. The dividers may be held by divider clips 130. FIGS. 22 and 23 are cross-sections through the plane A-A in FIG. 21. Front upward wall 120 is inserted into the gap between crossbar 24 and panel front 22 and may be secured there in similar manner as insert 26. Side upward walls 122 may be secured to rear upward wall 124 by screws through holes 123. Both the front end and rear end of the side upward walls may engage the recesses of front and rear crossbars 24 respectively to further secure the walls within the drawer frame. In FIG. 23, slats 68 and rear upward wall 124 are hidden to further show how side upward walls 122 engage the crossbars and short internal crossbar 67.

Figure 24:
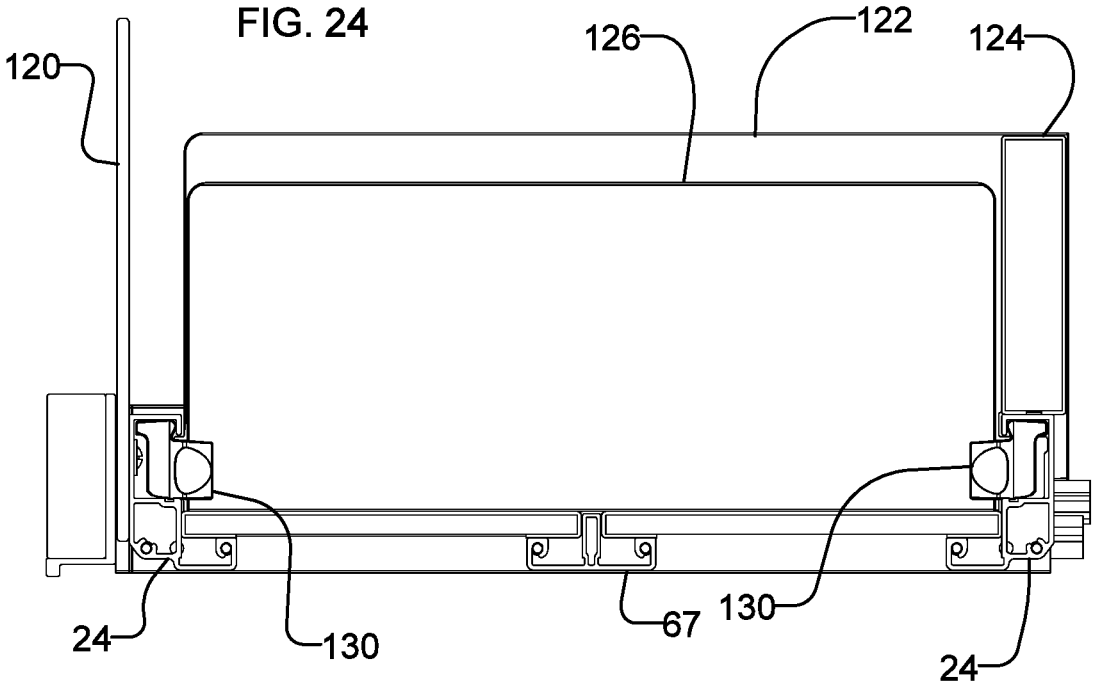
FIG. 24 is a cross-section taken through the plane B-B in FIG. 21.
Figure 25:
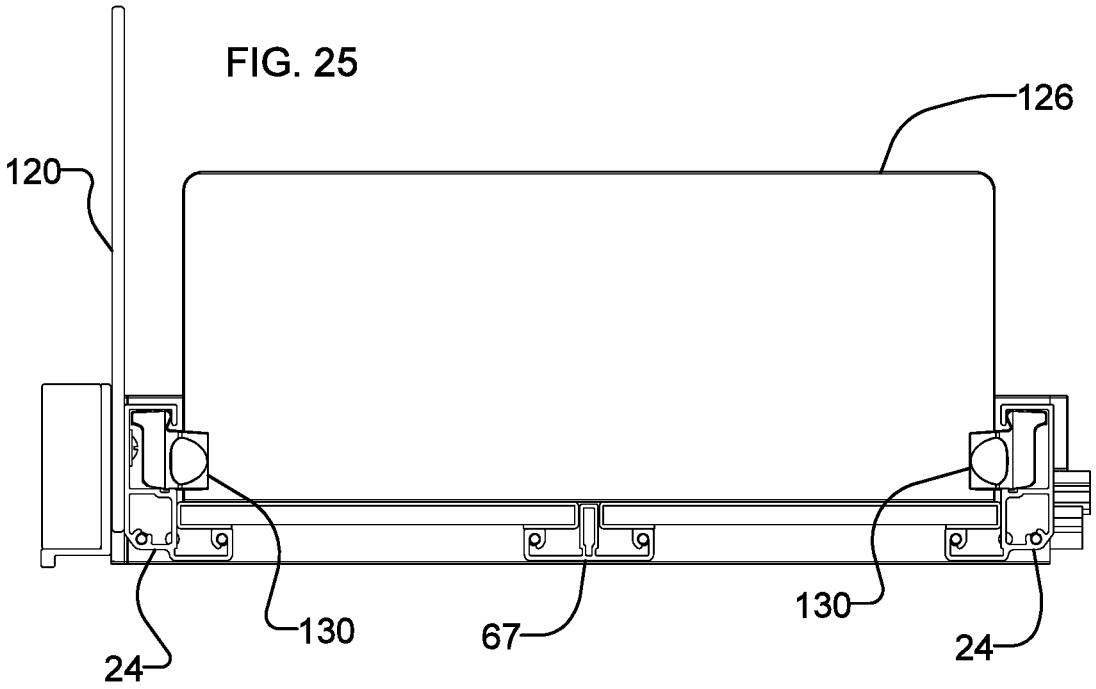
FIG. 25 is a cross-section taken through the plane B-B in FIG. 21 in which the rear upward wall and side upward walls are hidden.
Figure 26:
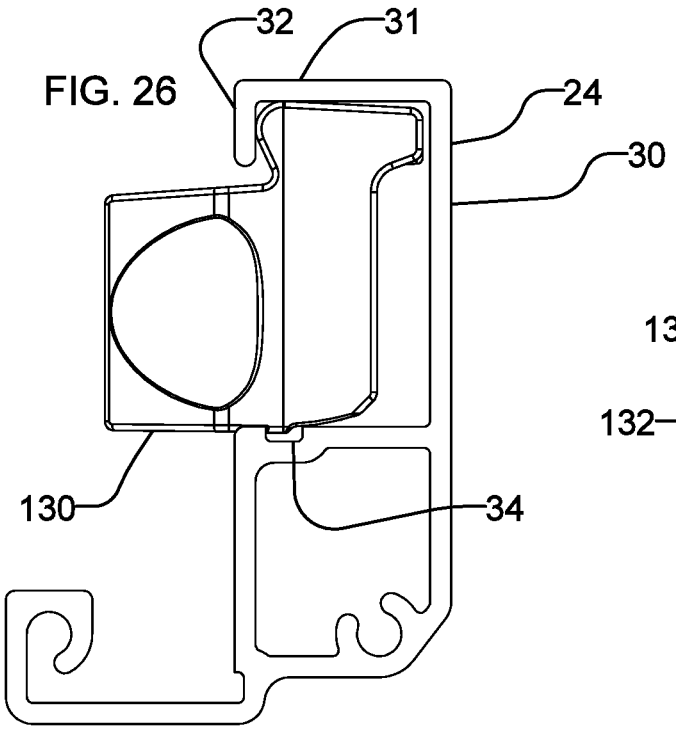
FIG. 26 is a side view of a crossbar divider clip inserted in a crossbar.
Figure 27:
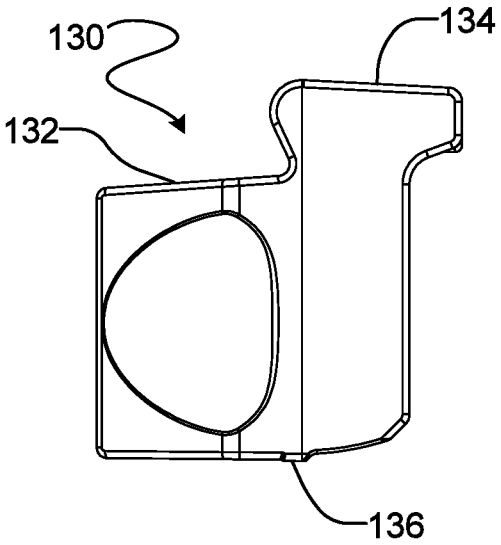
FIG. 27 is a side view of a crossbar divider clip.
Figure 28:
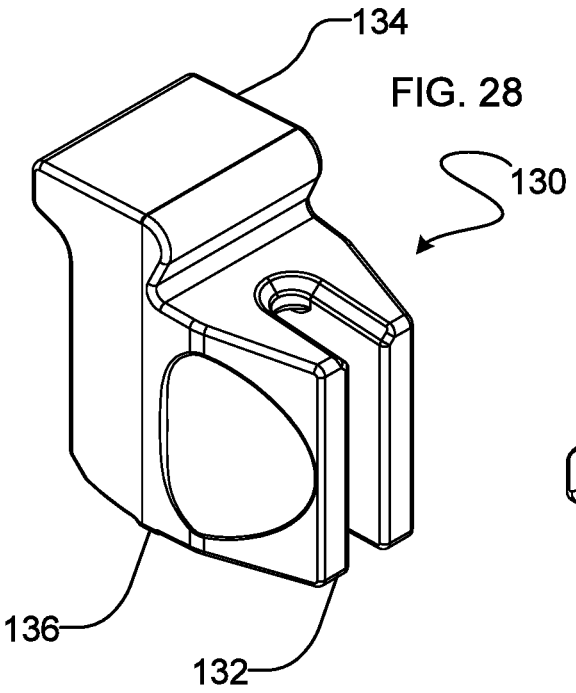
FIG. 28 is an isometric view of the top and front sides of a crossbar divider clip.
Figure 29:
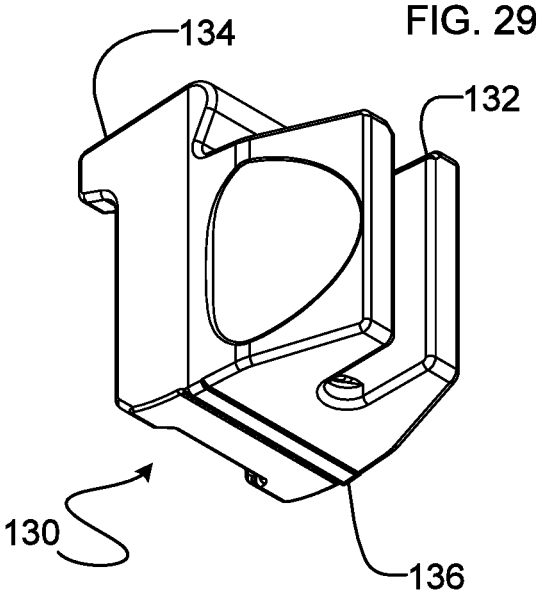
FIG. 29 is an isometric view of the bottom and front sides of a crossbar divider clip.
Figure 30:
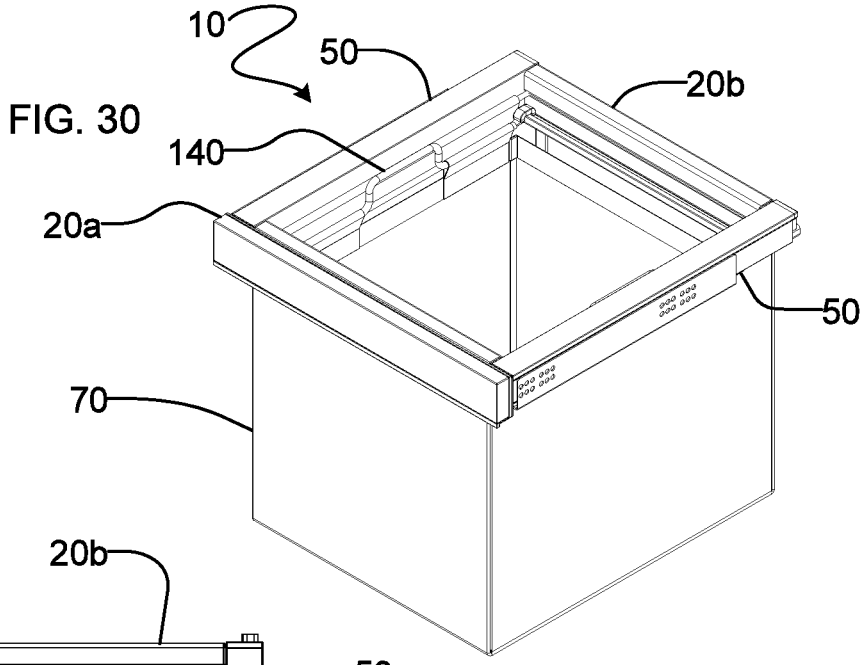
FIG. 30 is an isometric view of an embodiment of the drawer providing a hamper.

FIGS. 24 and 25 are cross-sections taken through the plane B-B in FIG. 22. Relative to FIG. 23 there is additionally shown dividers 126 and divider clips 130. Divider clips 130 may fit into the recesses of crossbars 24, with a pair of divider clips 130 for each divider 126 holding the divider at each end. In FIG. 25, the side upward walls 122 and rear upward wall 124 are hidden.

The divider clips 130 are designed to fit into the recess of the crossbar 24 to secure the dividers in an upright position. In the present embodiment, the divider clips 130 have a vertical groove 132 to hold vertical the ends of the dividers 126. Each divider clips also has an upper section 134 designed to fit snugly into the space between the front side 30, top side 31 and downwardly extending tongue 32 of the crossbar 24. Each divider clip 130 may also include a ridge 136 shaped to engage the recess channel 34 of the crossbar 24. In this embodiment a pair of divider clips is inserted into the recess of opposing crossbars 24 for each divider being used in the drawer.

Figure 31:
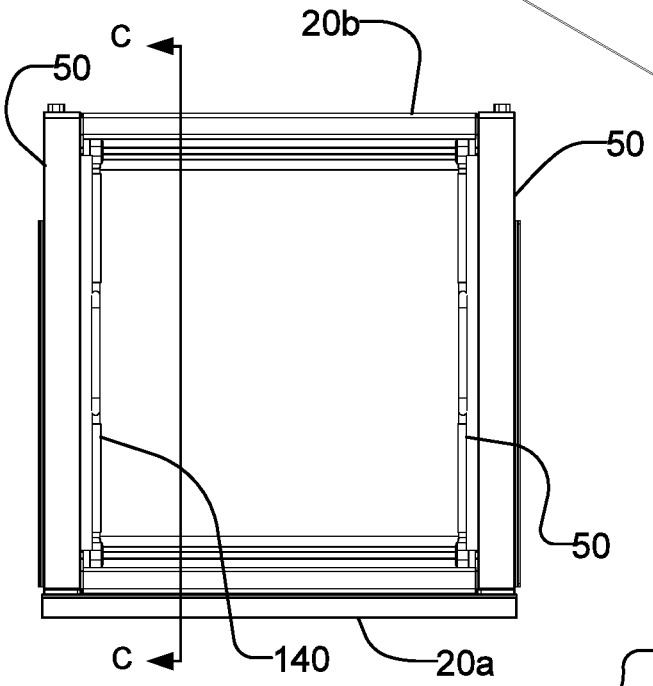
FIG. 31 is a top view of the drawer hamper of FIG. 30.
Figure 32:
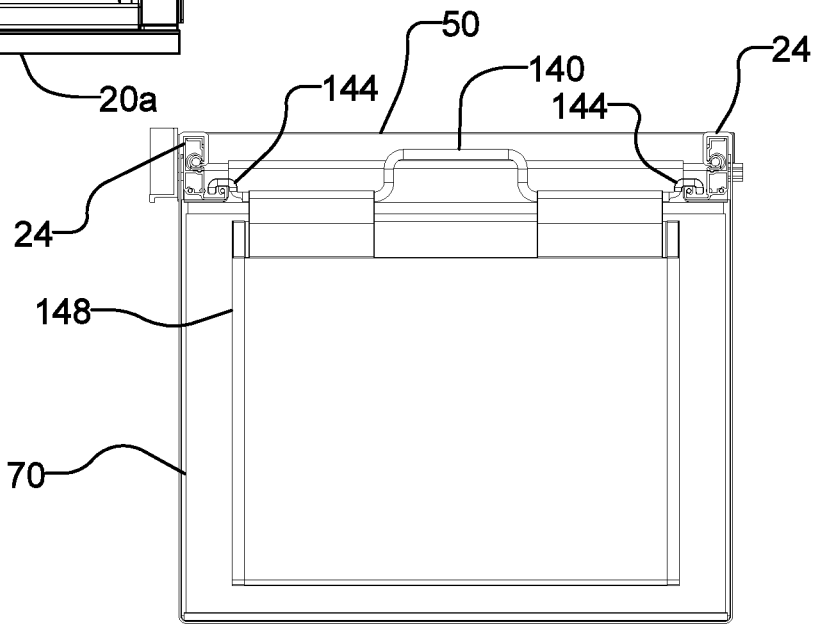
FIG. 32 is a cross-section of the drawer hamper embodiment taken through the plane C-C in FIG. 31.
Figure 36:
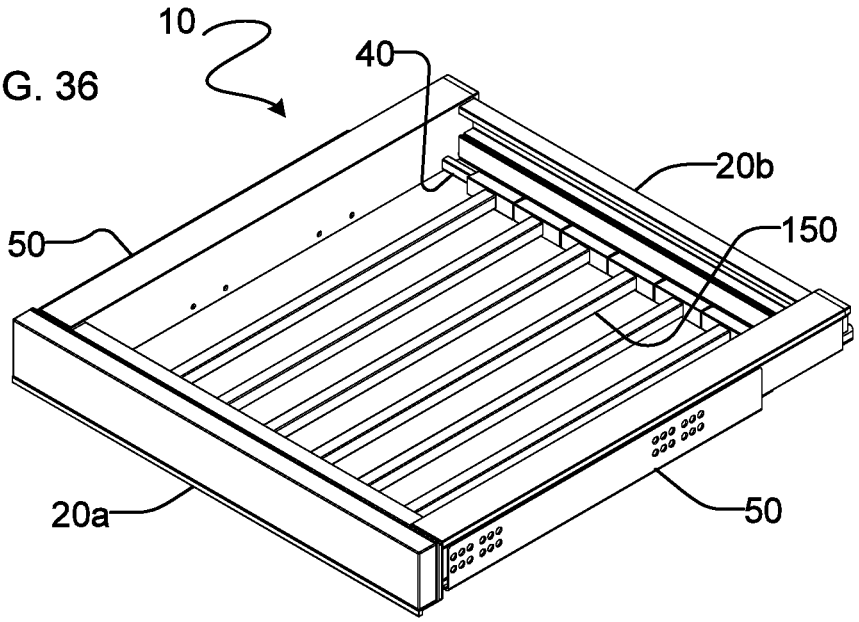
FIG. 36 is an isometric view of an embodiment of the drawer providing a garment organizer.
Figure 37:
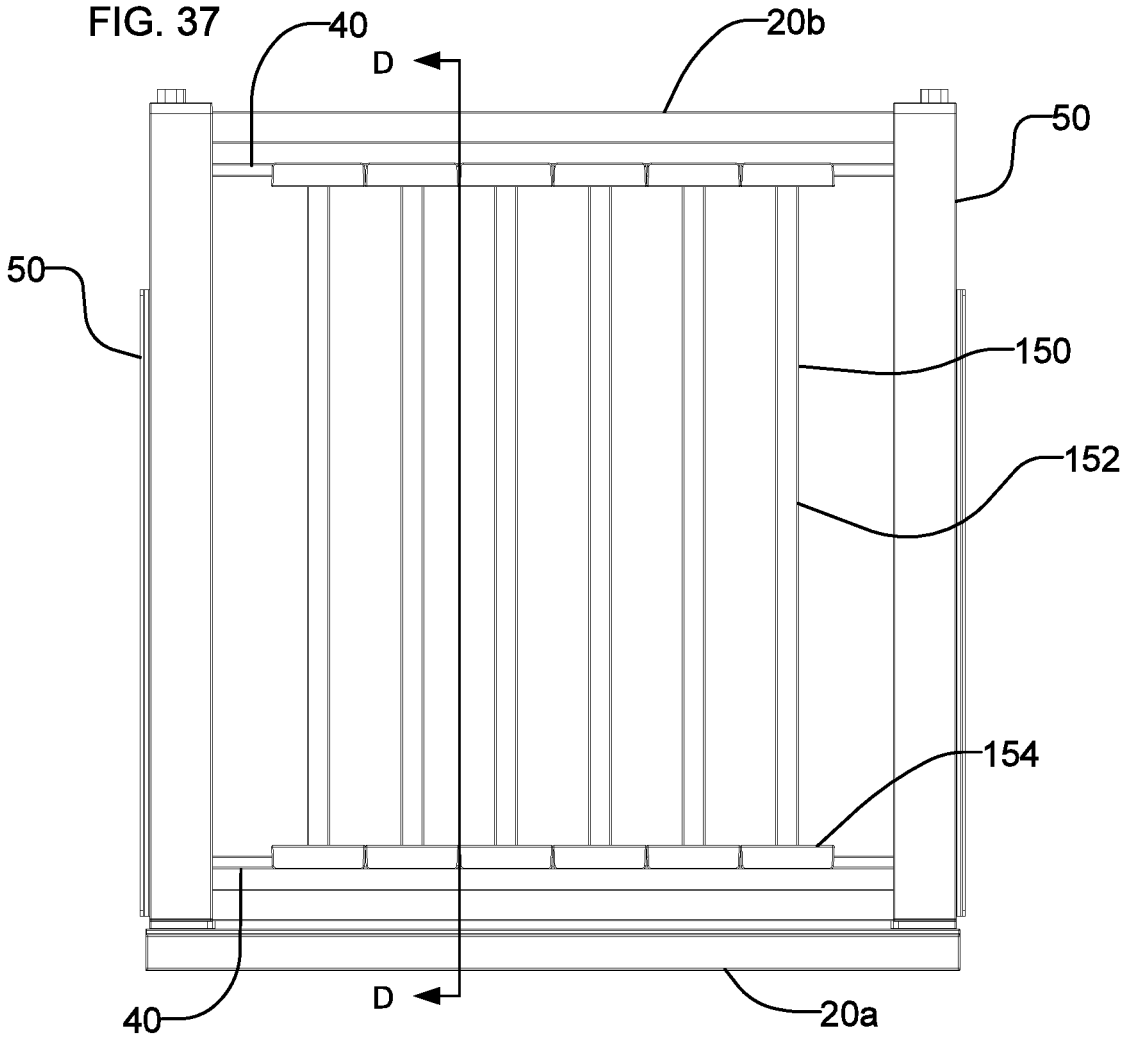
FIG. 37 is a top view of the garment organizer drawer of FIG. 36.
Figure 38:
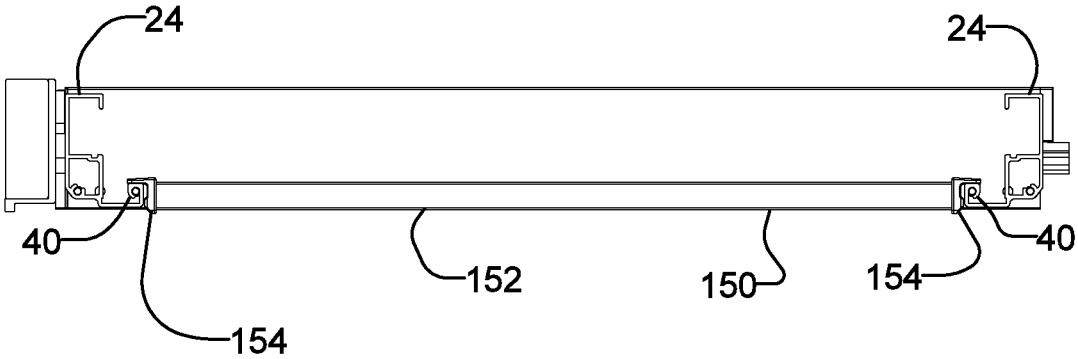
FIG. 38 is a cross-section taken through the plane D-D in FIG. 37 of the garment organizer drawer of FIG. 36.
Figure 39:
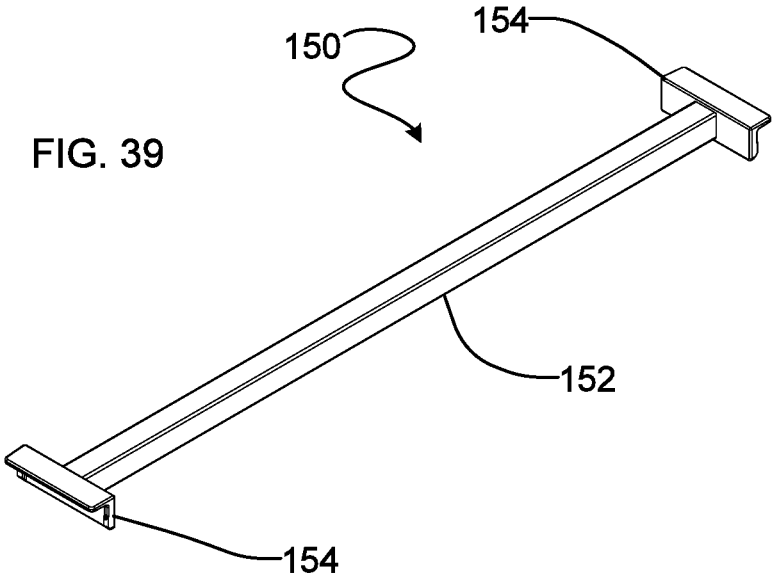
FIG. 39 is an isometric view of an organizer rod of the garment organizer drawer of FIG. 36.

Referring now to FIGS. 30-35, there is shown a further embodiment of the drawer 10 providing a basket 70 and hamper 148. FIG. 31 shows a top view of the drawer with basket and hamper and FIG. 32 shows a cross-section taken through the plane C-C in FIG. 31. The hamper 148 may be held by hamper handles 140. Each hamper handle 140 includes a handle portion 142, handle hooks 144 and handle rods 146. Each of the handle rods 146 may pass through hamper loops 147 extending upwardly from the tops of the side walls of the hamper 148 to allow the hamper handles to suspend the hamper within the drawer. In this embodiment, the drawer frame may comprise variants of the crossbars 24 including feet 40, such that each of the handle hooks 144 may engage a foot 40 of crossbars 24 to suspend the hamper from front and rear ends of the drawer frame. Handle portions 142 of hamper handles 140 may extend upward from a section of the hamper handle rods 146 to provide a section that may be gripped and lifted by a person so as to permit removal of the hamper 148 from the drawer 10.

Figure 40:
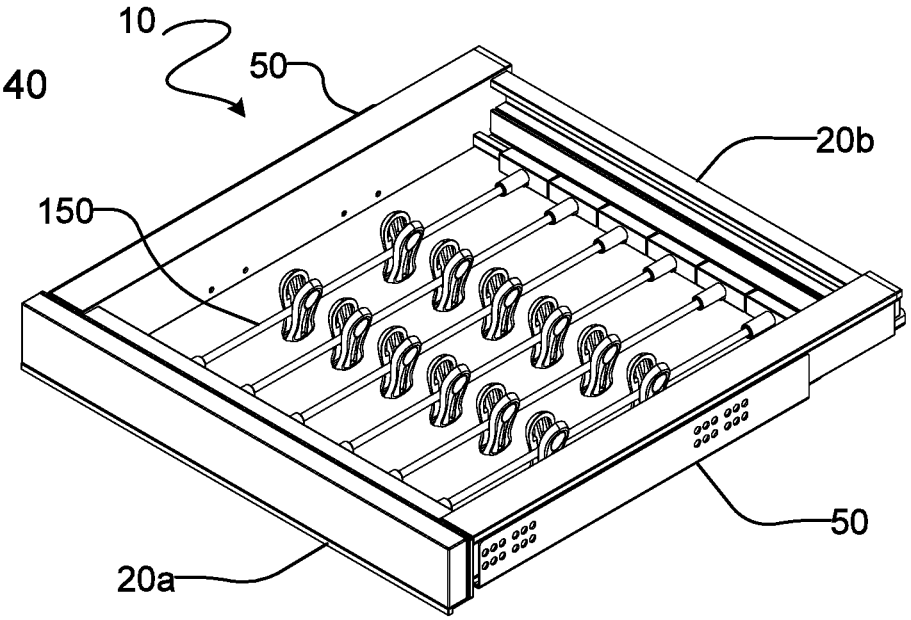
FIG. 40 is an isometric view of a variant garment organizer drawer providing garment clips.
Figure 41:
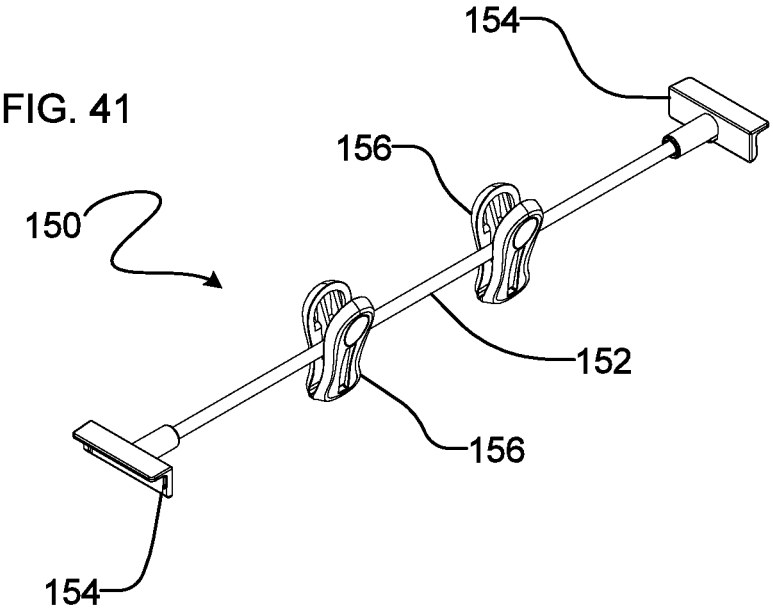
FIG. 41 is an isometric view of an organizer rod according to the embodiment shown in FIG. 40.
Figure 42:
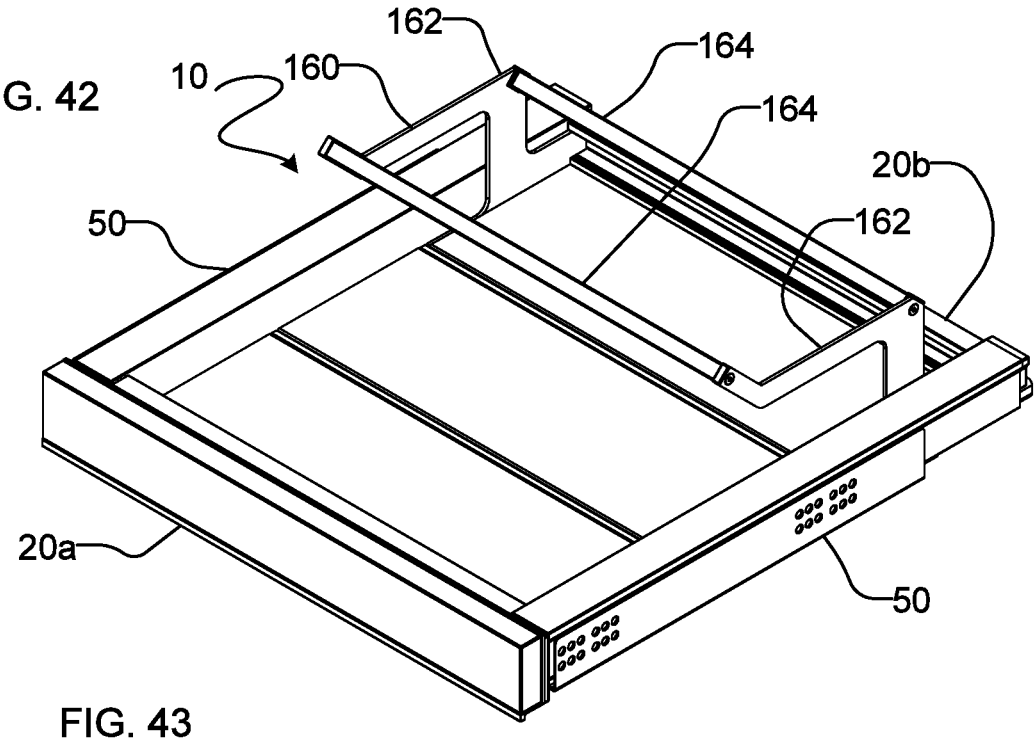
FIG. 42 is an isometric view of an embodiment of the drawer providing a shoe rack.
Figure 43:
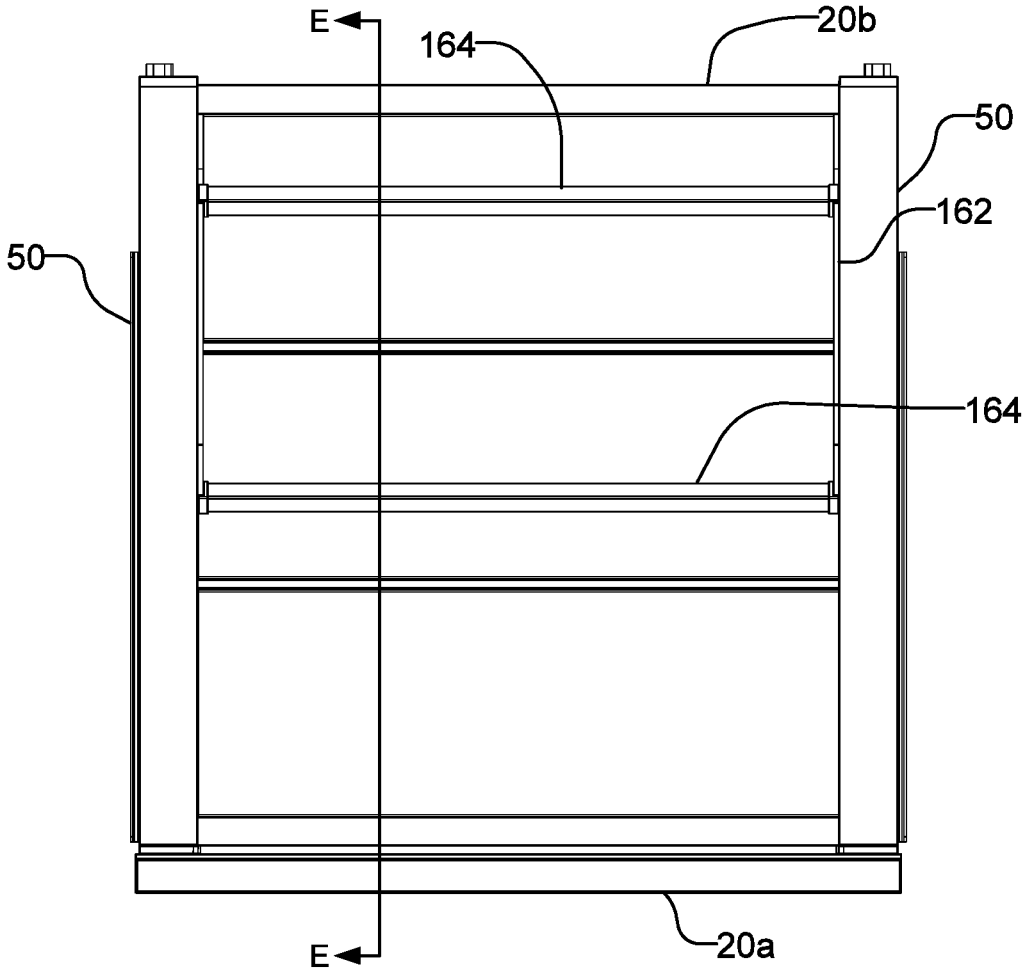
FIG. 43 is a top view of the embodiment shown in FIG. 42.

Referring now to FIGS. 36-39, there is shown a yet further embodiment of the drawer 10 providing a garment organizer. Each organizer rod 150 may include a rod portion 152 and a claw portion 154 at each end of the rod portion 152. The claw portions 154 can rest upon the feet 40 of crossbars. In some variants (not shown) of a garment organizer the claw portions might alternatively engage the recess 35 of crossbar 24. In such embodiments the claw portion 154 may have structure resembling the recess portions of divider clips 130. While the organizer rods of this embodiment are shown having a square cross-section, any of a variety of cross-sections may be used. For example, in a further variation shown in FIGS. 40 and 41, there is provided a garment organizer in which the organizer rods 150 have a circular cross-section. In this embodiment, the circular cross-section has the benefit of providing an even surface to be engage by garment clips 156.

Figure 44:
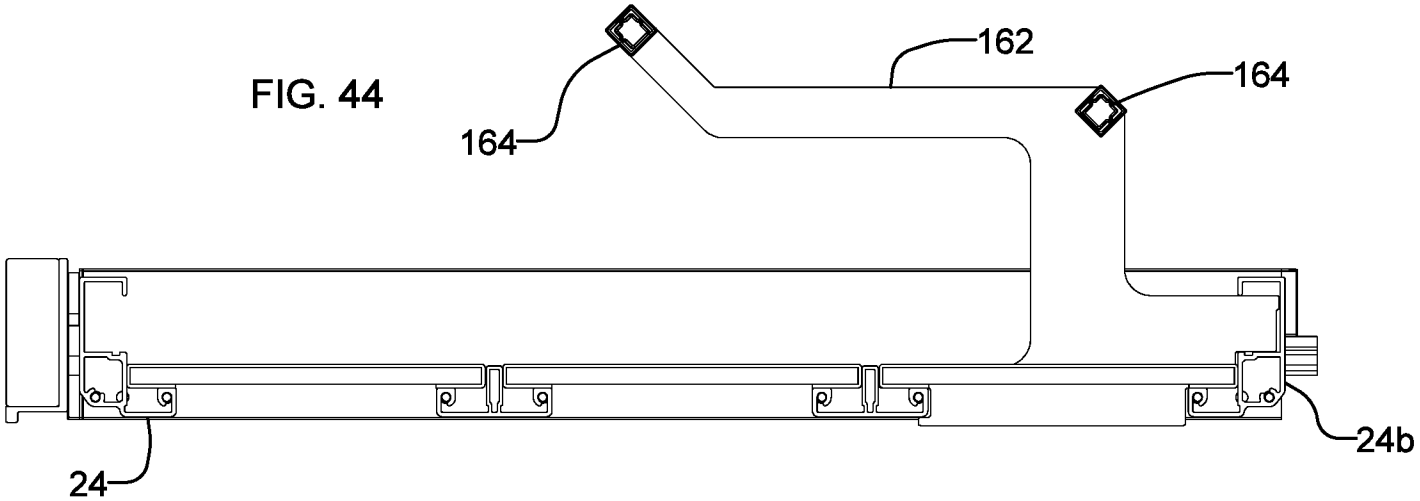
FIG. 44 is a cross-section of the embodiment shown in FIG. 42 taken through the plane E-E in FIG. 43.
Figure 45:
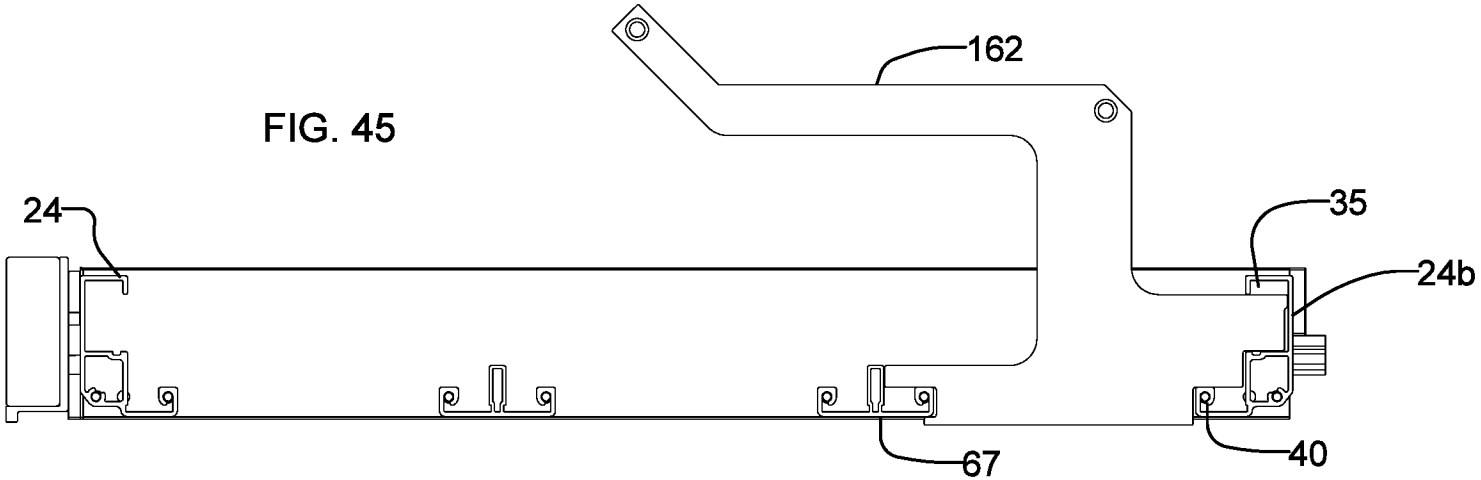
FIG. 45 is a further cross-section of the embodiment shown in FIG. 42 taken through the plane E-E in FIG. 43 in which the horizontal bars and slats are hidden.

In a yet further embodiment a drawer 10 may provide a shoe rack 160. The shoe rack 160 may have horizontal bars 164 which are held by rack side walls 162, as shown in FIGS. 42-45. FIGS. 44 and 45 are cross-sections taken through the plane E-E. In FIG. 45 the slats 68 and horizontal bars 164 are hidden to better show how side walls 162 of shoe rack 160 engage the rear crossbar 24*b* and short internal crossbar 67. In the assembled state, horizontal bars 164 prevent sideways motion of the rack side walls 162 and the engagement of the rack side walls 162 with short internal crossbar 67, crossbar foot 40 and crossbar recess 35 prevents forward and rearward motion, thereby securing the shoe rack 160 within the drawer.

Figure 47:
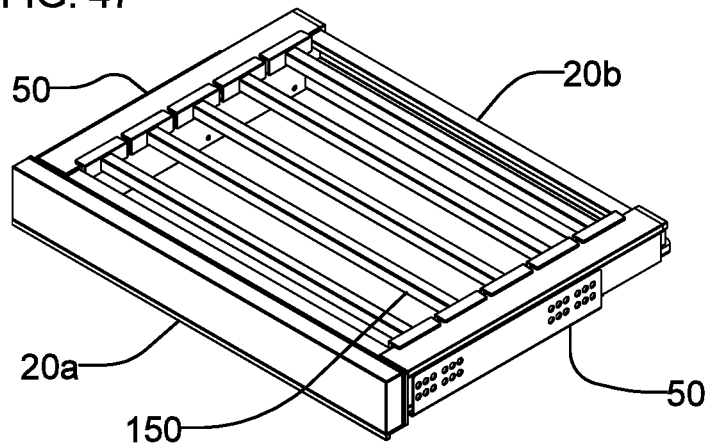
FIG. 47 is an isometric view of an embodiment of the drawer providing a garment organizer in which the organizer rods extend between the side bars of the drawer.
Figure 48:
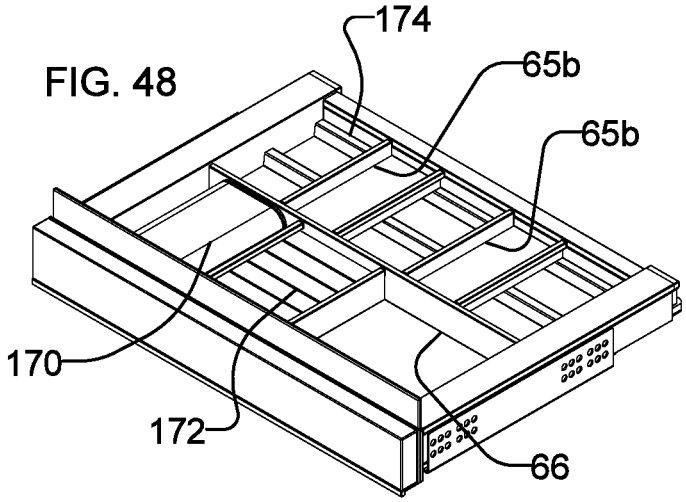
FIG. 48 is an isometric view of an embodiment of the drawer providing a variety of inserts including a watch pillow and a ring organizer.
Figure 49:
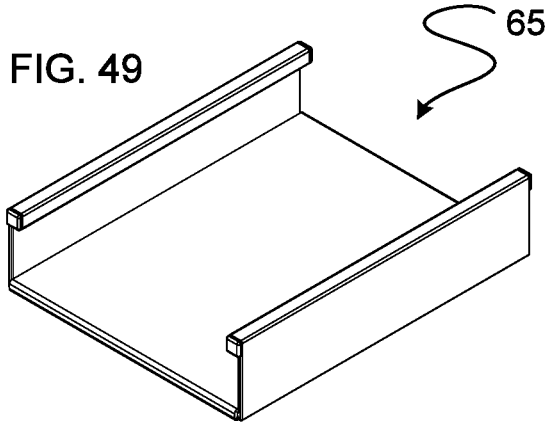
FIGS. 49-52 are isometric views of a U-shaped divider, a ring organizer, a narrow U-shaped divider and a watch pillow respectively.
Figure 50:
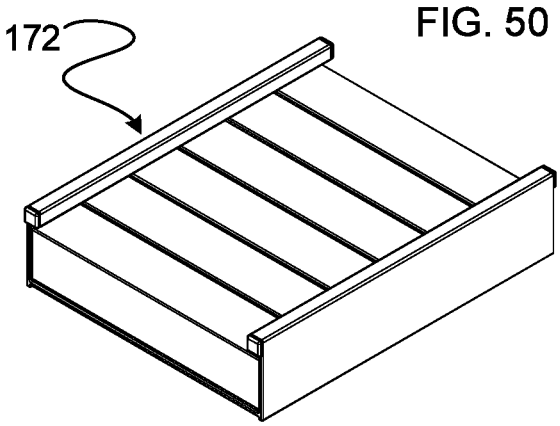
Figure 51:
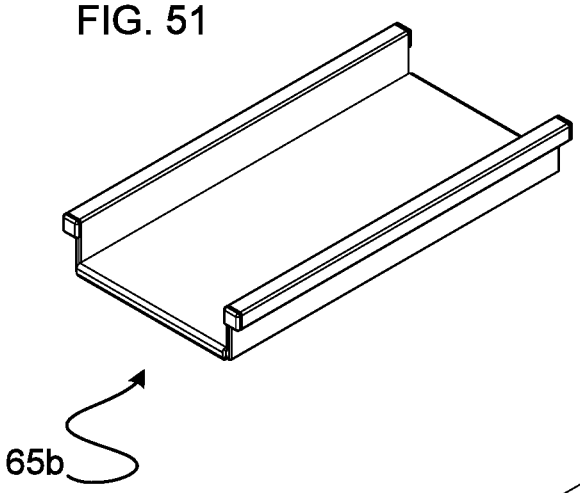
Figure 52:
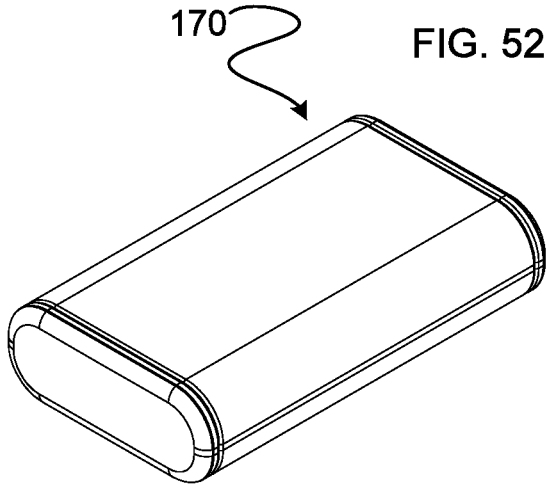
Figure 53:
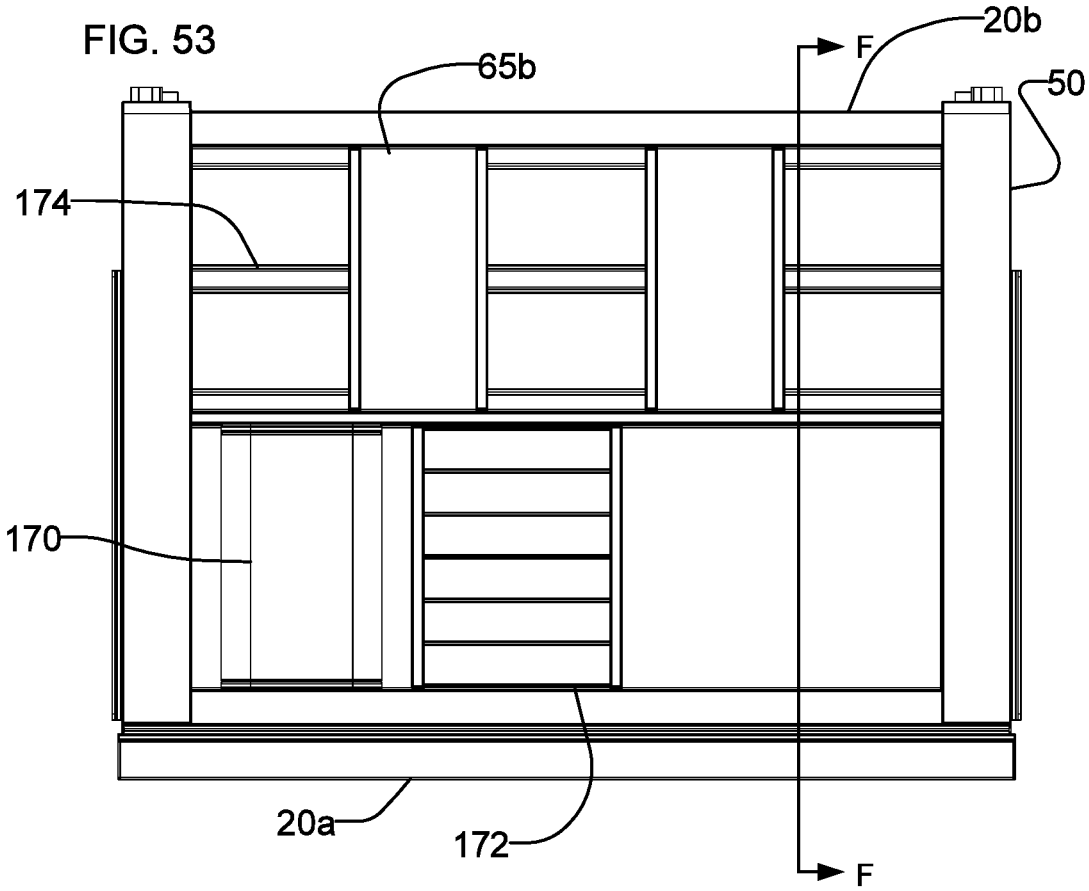
FIG. 53 is a top view of the embodiment shown in FIG. 48.
Figure 54:
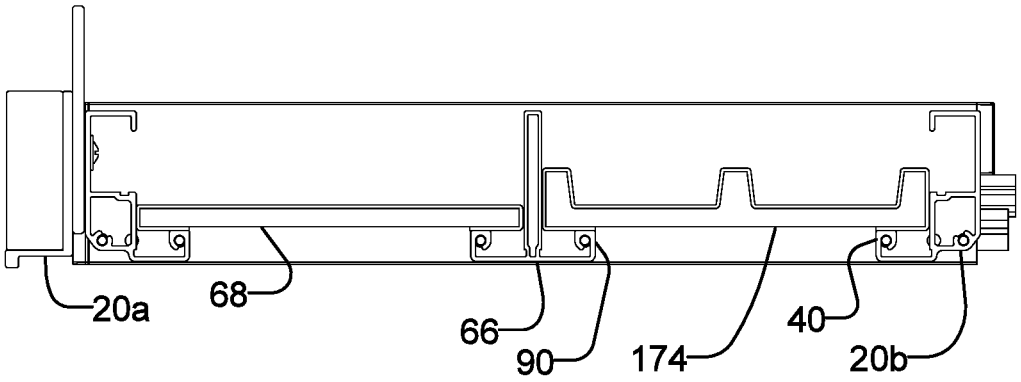
FIG. 54 is a cross-section of the embodiment taken through the plane F-F as shown in FIG. 53.

FIGS. 46-48 illustrate a number of additional example embodiments of the drawer 10. FIG. 46 illustrates a variant of the drawer 10 as shown in FIGS. 14-19 but having no inserts and employing a short internal crossbar 67. This variant provides a simple versatile flat drawer. FIG. 47 shows a further embodiment of the drawer 10 providing a garment organizer similar to those shown in FIGS. 36-41 but in which the organizer rods 150 are suspended from and extend between the side bars 50 instead of between the front and rear ends 20*a* and 20*b* of the drawer. FIG. 48 shows a variant of the drawer of FIGS. 14-19 having a variety of inserts including a U-shaped divider 65, a watch pillow 170, a ring holder 172, a generalized organizer 174 and a narrow U-shaped divider 65*b*. Examples of several of the inserts are shown in greater detail in FIGS. 49-52. FIGS. 53 and 54 provide a top view and a cross-section through the plane F-F of the variant shown in FIG. 48. As shown in FIG. 54 slats 68 may provide a base for the drawer or alternatively, an insert may be sized to rest upon internal crossbar feet 90 and crossbar feet 40 in similar manner as slats 68.

In the various exemplary embodiments illustrated in the figures and described herein many components of the drawer may be versatile in that they may be used across several different embodiments of a drawer. For example the two variants of crossbar 24 described here may each be used across several of the embodiments described. The combination of the versatility of the components and the ease of assembly of the drawer can be advantageous in that prior to sale relatively few parts may be kept on hand at any given time while permitting a great variety of variant drawers to be put together and sold to customers.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. A drawer comprising:

a drawer frame comprising:

a panel front;

a front crossbar comprising a top wall, a front wall and a floor, the top wall, front wall and floor together defining an inwards-facing recess;

a rear crossbar; and a first side bar and a second side bar, each of the first side bar and second side bar having first ends connected to respective ends of the front crossbar and second ends connected to respective ends of the rear crossbar, wherein the panel front and the front crossbar are secured together to leave a gap across substantially an interior length of each of the panel front and the front crossbar, the gap configured to receive one or more of a rigid insert or a fabric material; and a basket, the basket comprising a front edge, a rear edge, two side edges, and a front loop extending upwards from the front edge of the basket, the front loop passing through the gap between the panel front and the front crossbar, the front loop passing over the front crossbar and inserted into the recess in the front crossbar.

2. The drawer of claim 1 wherein the drawer frame further comprises a rod and a crossbar clip, the rod inserted into the front loop, the front loop and the rod inserted into a rod channel in the crossbar clip; and wherein insertion of the front loop into the recess in the front crossbar comprises insertion of the crossbar clip, the front loop and the rod into the crossbar recess.

3. The drawer of claim 2 wherein the front crossbar further comprises a recess channel in the floor and the crossbar clip further comprises a ridge and upon insertion of the crossbar clip into the crossbar recess the crossbar clip ridge engages the recess channel to further secure the crossbar clip within the crossbar recess.

4. The drawer of claim 3, wherein:

the rear crossbar comprises a rear crossbar top wall, a rear crossbar front wall and a rear crossbar floor, the rear crossbar top wall, rear crossbar front wall and rear crossbar floor together defining an inwards-facing rear crossbar recess; and the basket further comprises a rear loop extending upwards from the rear edge of the basket, the rear loop inserted into the rear crossbar recess.

5. The drawer of claim 4 wherein the drawer frame further comprises a second rod and a second crossbar clip, the second rod inserted into the rear loop, the rear loop and the inserted second rod inserted into a second rod channel in the second crossbar clip, the second crossbar clip inserted into the rear crossbar recess.

6. The drawer of claim 5 wherein the rear crossbar floor comprises a rear crossbar recess channel and the second crossbar clip further comprises a ridge and upon insertion of the second crossbar clip into the recess of the rear crossbar the second crossbar clip ridge engages the rear crossbar recess channel to further secure the crossbar clip within the rear crossbar recess.

7. The drawer of claim 4 wherein the basket further comprises side loops extending upwards from the side edges of the basket, and wherein the side loop rods are inserted in the side loops, each of the side loop rods comprising first and second rods ends engaging the front and rear crossbar recesses respectively.

8. The drawer of claim 1 wherein the panel front is fastened to the first and second side bars through first and second side bar spacers.

9. The drawer of claim 8 wherein a width of the gap between the panel front and the front crossbar is substantially defined by the thickness of the side bar spacers.

10. A drawer comprising:

a panel front;

a front crossbar secured to the panel front to leave a gap across substantially an interior length of each of the panel front and the front crossbar, the gap configured to receive one or more of a rigid insert or a fabric material;

a rear crossbar;

a first side bar and a second side bar, each of the first side bar and the second side bar having first ends connected to respective ends of the front crossbar and second ends connected to respective ends of the rear crossbar; and a drawer basin, wherein the front crossbar comprises a recess and the drawer basin comprises a basket, the basket comprising front, rear and side edges and a front loop extending from the front edge of the basket, the front loop passing through the gap between the panel front and the front crossbar, the front loop passing over the front crossbar and inserted into the recess in the front crossbar.

* * * * *